US009387579B2

(12) United States Patent
Johnson

(10) Patent No.: US 9,387,579 B2
(45) Date of Patent: Jul. 12, 2016

(54) ADJUSTABLE TOOL HANDLE FOR HOLDING A TOOL DURING USE

(75) Inventor: Ronald L. Johnson, San Jose, CA (US)

(73) Assignee: WAGIC, INC., Los Gatos, CA (US)

( * ) Notice: Subject to any disclaimer, the term of this patent is extended or adjusted under 35 U.S.C. 154(b) by 450 days.

(21) Appl. No.: 13/472,341

(22) Filed: May 15, 2012

(65) Prior Publication Data

US 2013/0305885 A1 Nov. 21, 2013

(51) Int. Cl.

| | |
|---|---|
| ***B25G 3/00*** | (2006.01) |
| ***B25G 1/00*** | (2006.01) |
| ***B25B 23/00*** | (2006.01) |
| ***B25G 1/06*** | (2006.01) |
| ***B25G 3/28*** | (2006.01) |
| ***B25G 3/24*** | (2006.01) |

(52) U.S. Cl.

CPC *B25G 1/06* (2013.01); *B25G 1/063* (2013.01); *B25G 3/24* (2013.01); *B25G 3/28* (2013.01); *Y10T 29/49826* (2015.01)

(58) Field of Classification Search

CPC ..... B25G 1/06; B25G 1/063; B25G 3/24; B25G 3/28; B25G 1/005

USPC ..... 81/436, 491, 177.85

See application file for complete search history.

(56) References Cited

U.S. PATENT DOCUMENTS

| | | | |
|---|---|---|---|
| 244,309 | A | 7/1881 | Rhodes |
| 363,331 | A | 5/1887 | Hammer |
| 364,422 | A | 6/1887 | LaForge |
| 580,235 | A | 4/1897 | Strum |
| 647,528 | A | 4/1900 | Schmidt |
| 763,745 | A | 6/1904 | Gheen |
| 776,761 | A | 12/1904 | Sampson |
| 873,363 | A | 12/1907 | Ross |
| 875,493 | A | 12/1907 | Beard |
| 959,408 | A | 5/1910 | Volbert |
| 1,000,900 | A | 8/1911 | Dorsey |
| 1,006,679 | A | 10/1911 | Rice |
| 1,100,070 | A | 6/1914 | Graham |
| 1,172,656 | A | 2/1916 | Yorgensen |
| 1,187,542 | A | 6/1916 | Kaas |
| D53,597 | S | 7/1919 | Marcmann |
| 1,398,583 | A | 11/1921 | Bovee |
| 1,425,270 | A | 8/1922 | Morgan |
| 1,500,852 | A | 7/1924 | Shepard |

(Continued)

FOREIGN PATENT DOCUMENTS

| | | |
|---|---|---|
| CA | 1147176 | 5/1983 |
| CA | 1232781 A | 2/1988 |

(Continued)

OTHER PUBLICATIONS

Wagic Husky 26pc SAE& Metric Ball-Head Key Set w/ Torque Handle, http://www.bing.com/shopping/wagic-husky-26pc-sae-metric-ball-head-hex-key-set-w-tor . . . , May 10, 2012.

*Primary Examiner* — Bryan R Muller

(74) *Attorney, Agent, or Firm* — Haverstock & Owens LLP

(57) ABSTRACT

An adjustable tool handle for holding a tool during use provides an improved handling of tools during use of tools that are difficult to use on their own, specifically L-shaped hexagonal and round wrenches. The adjustable tool handle includes a tool handle body with a handle and an adjustable opening for receiving a tool. In order to place a tool within the tool handle, a user opens the tool handle and places the tool within the handle. After the tool is placed within the handle the tool is held in place by a holding component. The tool handle is also usable with a removable ratcheting mechanism. When the ratcheting mechanism is attached to the tool handle, the ratcheting mechanism couples with a plurality of bits or sockets of different sizes and different types.

11 Claims, 16 Drawing Sheets

(56) References Cited

U.S. PATENT DOCUMENTS 1,502,044 A 7/1924 McCann
1,530,905 A 3/1925 Nance
1,559,097 A 10/1925 Hill
1,753,026 A 4/1930 Rosati
1,825,936 A 10/1931 Bodmer
1,888,222 A 11/1932 Curtis et al.
1,915,245 A 6/1933 Cook
1,944,606 A 1/1934 Little
1,970,409 A 8/1934 Wiedemann
2,236,333 A 3/1941 Cowles
2,332,656 A 10/1943 Mirando
2,346,364 A 4/1944 Dowe
D142,982 S 11/1945 Bloomfield
2,409,613 A 10/1946 Brooks
2,410,971 A 11/1946 Hartley
2,465,152 A 3/1949 Ellison
2,465,619 A 3/1949 Veit
2,475,268 A 7/1949 Wittle
2,485,991 A 10/1949 Stowell
D156,677 S 12/1949 Smith
D157,154 S 2/1950 Horton
2,509,507 A 5/1950 Kane
2,512,967 A 6/1950 Quiron
2,530,024 A 11/1950 Moody
2,532,636 A 12/1950 Minnich
2,569,069 A * 9/1951 Motel ..... B25G 1/005 16/429
2,590,307 A 3/1952 Gibson
2,593,828 A * 4/1952 Arey ..... B25B 13/56 81/174
2,604,211 A 7/1952 Steine
2,701,052 A 2/1955 Mantel
D175,056 S 6/1955 Wilson
2,715,028 A 8/1955 Dossie
2,719,042 A 9/1955 Epsy
2,726,091 A * 12/1955 Topar ..... B25B 15/008 279/75
2,776,589 A 1/1957 Gregory
2,778,396 A 1/1957 Swain
D179,979 S 4/1957 Noga
2,797,599 A * 7/1957 McGarvie, Jr. ..... B25B 13/466 81/436
2,800,816 A 7/1957 Tasciotti
2,804,970 A 9/1957 Kuc et al.
2,810,472 A 10/1957 Midkiff
2,836,210 A 5/1958 Garofalo
2,842,020 A 7/1958 Traquinio
2,844,244 A 7/1958 Hanson
2,851,915 A 9/1958 Martinez
2,854,741 A 10/1958 Cholger
2,878,701 A 3/1959 Weersma
3,023,054 A 2/1962 Shigekuni
3,061,927 A 11/1962 Von Frankenberg Und Ludwingdorf
3,113,479 A 12/1963 Swingle
3,156,143 A 11/1964 Wolfe
3,222,959 A 12/1965 Clark
3,255,792 A 6/1966 Beck
3,257,991 A 6/1966 Mosch
D205,745 S 9/1966 Namfeldt
3,342,229 A 9/1967 Janes
3,343,434 A 9/1967 Schroeder
3,370,696 A 2/1968 Groe
3,424,039 A 1/1969 Scott
3,592,086 A 7/1971 Derwin
3,654,975 A 4/1972 Ballsmith et al.
3,667,518 A 6/1972 Stillwagon, Jr.
3,802,286 A 4/1974 Winklofer et al.
3,863,693 A 2/1975 Carniker
3,943,801 A 3/1976 Yates
3,958,469 A 5/1976 Meese
3,997,053 A 12/1976 Bondhus
4,000,767 A 1/1977 Geng
4,043,230 A 8/1977 Scrivens
4,124,915 A 11/1978 Schlicher
4,154,125 A 5/1979 Frank
4,196,761 A 4/1980 Royer
4,227,430 A 10/1980 Jansson et al.
4,235,269 A 11/1980 Kraus
4,238,862 A 12/1980 Leatherman
4,241,773 A 12/1980 Personnat
4,302,990 A 12/1981 Chrichton et al.
4,308,770 A * 1/1982 MacDonald ..... B25B 13/481 81/177.2
4,310,094 A 1/1982 Hotchkiss
4,327,790 A 5/1982 Stevens et al.
4,384,499 A 5/1983 Shockley
D270,024 S 8/1983 Strasser
4,424,728 A 1/1984 MacDonald
4,448,097 A 5/1984 Rocca
4,469,109 A 9/1984 Mehl
4,476,751 A 10/1984 Mishima
4,525,889 A 7/1985 Dunau
4,542,667 A 9/1985 Jang
D284,810 S 7/1986 Kelemen, Sr.
4,598,822 A 7/1986 Hemmings
4,640,155 A * 2/1987 Condon ..... B25B 23/16 74/551.9
4,667,822 A 5/1987 Coopmans
4,699,020 A 10/1987 Bush et al.
4,699,030 A 10/1987 Yang
4,703,673 A 11/1987 Allen
4,711,353 A 12/1987 Rozmestor
4,716,795 A 1/1988 Corona et al.
4,716,796 A 1/1988 Corona et al.
4,767,006 A 8/1988 Wasem
4,783,867 A 11/1988 Tsao
4,787,276 A * 11/1988 Condon ..... B25G 3/18 81/177.1
4,815,346 A 3/1989 Littlehorn
4,819,523 A 4/1989 Souza
4,819,800 A 4/1989 Wilson
4,820,090 A 4/1989 Chen
D302,102 S 7/1989 Amagaya
4,882,841 A 11/1989 Margolis
4,922,569 A 5/1990 Brinker et al.
4,926,721 A 5/1990 Hsiao
D308,462 S 6/1990 Komatsu
4,934,223 A 6/1990 Wong
D310,770 S 9/1990 Zamarripa
D311,124 S 10/1990 Learney
4,960,016 A 10/1990 Seals
4,974,477 A 12/1990 Anderson
4,979,407 A 12/1990 Hernandez et al.
5,029,707 A 7/1991 Feng
5,036,975 A 8/1991 Chow
5,042,658 A 8/1991 Tiramani et al.
5,062,173 A 11/1991 Collins et al.
5,063,796 A 11/1991 Gennep
5,065,487 A 11/1991 Yother
5,086,674 A 2/1992 Her
5,146,815 A 9/1992 Scott, III
5,147,038 A 9/1992 Pergeau
D333,769 S 3/1993 Jureckson
D334,516 S 4/1993 Tsunoda
D339,048 S 9/1993 Baum
5,251,352 A 10/1993 Cullison
5,263,389 A 11/1993 Frazell et al.
5,265,504 A 11/1993 Fruhm
D342,433 S 12/1993 Sorenson
5,271,300 A 12/1993 Zurbuchen et al.
D343,106 S 1/1994 Eklind et al.
5,295,422 A 3/1994 Chow
5,320,004 A 6/1994 Hsiao
5,329,834 A 7/1994 Wong
5,394,984 A 3/1995 Aiba
D359,671 S 6/1995 Acosta
5,421,225 A 6/1995 Chen
5,450,774 A 9/1995 Chang
5,450,775 A 9/1995 Kozak
5,461,950 A 10/1995 Iwinski
D365,681 S 1/1996 Chow
5,480,166 A 1/1996 Milsop
5,495,942 A 3/1996 Izhak

(56) References Cited

U.S. PATENT DOCUMENTS 5,499,560 A 3/1996 Aeschliman
5,499,562 A 3/1996 Feng
5,505,316 A 4/1996 Lee
5,517,885 A 5/1996 Feng
5,522,291 A 6/1996 Liu
5,535,882 A 7/1996 Liu
5,542,322 A 8/1996 Knox et al.
D373,943 S 9/1996 Fuhrmann
5,553,340 A 9/1996 Brown, Jr.
5,566,596 A 10/1996 Lin
D376,520 S 12/1996 Morin
5,581,834 A 12/1996 Collins
D377,444 S 1/1997 Lin
5,592,859 A 1/1997 Johnson et al.
D378,797 S 4/1997 Poremba et al.
5,630,342 A 5/1997 Owoc
D380,131 S 6/1997 Sung
D382,190 S 8/1997 Blackston et al.
5,653,525 A 8/1997 Park
D383,048 S 9/1997 Sorensen et al.
5,662,013 A 9/1997 Lin
D385,172 S 10/1997 Bramsiepe et al.
D386,955 S 12/1997 Jones et al.
5,692,656 A 12/1997 Dembicks
D388,609 S 1/1998 Chan
5,711,042 A 1/1998 Chuang
5,711,194 A 1/1998 Anderson et al.
D394,792 S 6/1998 Bourque
D394,794 S 6/1998 Vasudeva
5,758,870 A 6/1998 Weaver
5,765,247 A 6/1998 Seber et al.
5,765,454 A * 6/1998 Barbulescu ..... B25B 15/008 81/177.1
5,768,960 A 6/1998 Archuleta
5,791,211 A 8/1998 Bondhus et al.
5,802,936 A 9/1998 Liu
5,803,584 A 9/1998 Chung
5,816,401 A 10/1998 Vasudeva et al.
5,820,288 A 10/1998 Cole
5,822,830 A 10/1998 Lin
D400,775 S 11/1998 Hsu
5,855,274 A 1/1999 Piao
D405,335 S 2/1999 Lin
5,911,799 A 6/1999 Johnson et al.
5,916,277 A 6/1999 Dallas
5,916,341 A 6/1999 Lin
5,918,513 A 7/1999 Ho
5,918,741 A 7/1999 Vasudeva
5,938,028 A 8/1999 Hu
5,970,828 A 10/1999 Bondhus et al.
D415,946 S 11/1999 Tsai
5,983,759 A 11/1999 Turner
5,992,626 A 11/1999 Anderson
D420,885 S 2/2000 Lin
6,032,332 A 3/2000 Lin
6,032,796 A 3/2000 Hopper et al.
1,337,769 A 4/2000 Hemming
6,044,973 A 4/2000 Vasudeva
D426,449 S 6/2000 Eklind
D426,450 S 6/2000 Eklind
D427,875 S 7/2000 Chiu
6,085,620 A 7/2000 Anderson et al.
6,088,861 A 7/2000 Sessions et al.
6,089,133 A 7/2000 Liao
6,092,656 A 7/2000 Ernst
6,095,018 A 8/2000 Schuster
6,105,767 A 8/2000 Vasudeva
6,119,560 A 9/2000 Anderson et al.
6,128,981 A 10/2000 Bondhus et al.
6,131,740 A 10/2000 Huang
D433,613 S 11/2000 Jallin
D433,910 S 11/2000 Oliver et al.
6,151,998 A 11/2000 Fu-Hui
D435,415 S 12/2000 Johnson et al.
6,164,172 A 12/2000 Huang
D435,773 S 1/2001 Lin
D437,541 S 2/2001 Hermansen et al.
D437,763 S 2/2001 Oliver et al.
6,186,785 B1 2/2001 Rogers et al.
6,202,864 B1 3/2001 Ernst et al.
6,206,189 B1 3/2001 Huot, Jr. et al.
D440,852 S 4/2001 Ernst
6,233,769 B1 5/2001 Seber et al.
6,237,451 B1 5/2001 Wei
6,257,106 B1 7/2001 Anderson et al.
6,260,453 B1 7/2001 Anderson et al.
6,279,434 B1 8/2001 Brown
6,279,435 B1 8/2001 Zayat, Jr.
D448,267 S 9/2001 Jean et al.
6,308,599 B1 10/2001 Fu-Hui
6,311,587 B1 11/2001 Johnson et al.
6,314,600 B1 11/2001 Cachot
6,314,838 B2 11/2001 Wall
6,318,218 B1 11/2001 Anderson et al.
6,332,381 B1 12/2001 Vasudeva
6,345,557 B1 2/2002 Kuo
D454,766 S 3/2002 Lin
6,352,010 B1 3/2002 Giarritta et al.
6,357,068 B1 3/2002 Seber et al.
D455,630 S 4/2002 Chiu
6,371,290 B1 4/2002 Yearous et al.
6,378,402 B1 4/2002 Kalomeris et al.
6,382,057 B1 5/2002 Kienholz
6,389,931 B1 5/2002 Delaney et al.
6,397,709 B1 6/2002 Wall
6,401,576 B1 6/2002 Wu
6,401,923 B1 6/2002 Huang
6,405,620 B2 6/2002 Liao
D459,967 S 7/2002 Johnson et al.
D461,311 S 8/2002 Gharib
D462,002 S 8/2002 Jean et al.
6,427,564 B1 8/2002 Nelson
6,490,954 B2 12/2002 Johnson et al.
6,510,766 B1 1/2003 Lin
6,510,767 B1 1/2003 Rivera
D470,739 S 2/2003 Chen
D472,712 S 4/2003 Sagen
D472,931 S 4/2003 Leins
6,564,680 B1 5/2003 Rinner et al.
6,598,503 B1 7/2003 Cunningham
6,601,481 B2 8/2003 Chuang
6,606,925 B1 * 8/2003 Gmeilbauer ..... B25B 13/461 81/177.1
D479,963 S 9/2003 Chang
6,634,502 B1 10/2003 Yu
6,640,675 B1 11/2003 Chuang
6,675,678 B2 1/2004 Liu
6,698,318 B2 3/2004 Peters
6,701,813 B2 3/2004 Hu
6,709,196 B1 3/2004 Medendorp
6,739,224 B1 5/2004 Wershe
6,751,819 B2 6/2004 Chuang
6,751,820 B1 6/2004 Wu
6,752,046 B1 6/2004 Lee
6,758,350 B2 7/2004 Lin
6,763,744 B2 7/2004 Johnson et al.
D494,438 S 8/2004 Flakenstein et al.
6,799,490 B1 10/2004 Chu
6,827,210 B2 12/2004 Chen
6,863,471 B2 3/2005 Medendorp
6,877,186 B2 4/2005 Shiao
6,898,998 B2 5/2005 Shyu
6,901,826 B2 6/2005 Huang
6,918,323 B2 7/2005 Arnold et al.
6,922,870 B2 8/2005 Tontz, Sr.
6,925,910 B2 8/2005 Alford
6,928,908 B1 8/2005 Yu
6,935,211 B2 8/2005 Chen
6,935,212 B2 8/2005 Wadsworth
6,941,843 B2 9/2005 Johnson et al.
6,948,406 B1 9/2005 Li
6,968,758 B2 11/2005 Lin
6,988,616 B2 1/2006 Chen
D517,391 S 3/2006 Leins

(56) References Cited

U.S. PATENT DOCUMENTS

| | | | |
|---|---|---|---|
| 7,028,593 | B1 | 4/2006 | Lin et al. |
| 7,047,847 | B2 | 5/2006 | Chuang |
| 7,051,626 | B1 | 5/2006 | Chen |
| 7,051,629 | B2 | 5/2006 | Huang |
| D523,637 | S | 6/2006 | Chang |
| 7,073,418 | B2 | 7/2006 | Kuo |
| 7,080,582 | B2 | 7/2006 | Karle |
| 7,086,314 | B2 | 8/2006 | Wannop |
| 7,093,519 | B1 | 8/2006 | Huang |
| D527,903 | S | 9/2006 | Chan |
| 7,100,476 | B1 | 9/2006 | Feit |
| 7,131,358 | B2 | 11/2006 | Hsien |
| 7,140,280 | B2 | 11/2006 | Hawkins et al. |
| 7,143,669 | B2 | 12/2006 | Hu |
| 7,150,208 | B2 | 12/2006 | Debley |
| 7,155,998 | B1 | 1/2007 | Shyu |
| 7,159,260 | B2 | 1/2007 | Hansen |
| 7,159,491 | B1 | 1/2007 | Chaconas et al. |
| 7,165,479 | B1 | 1/2007 | Lee |
| 7,168,345 | B1 | 1/2007 | Hsieh |
| 7,182,003 | B1 | 2/2007 | Hsieh |
| 7,185,565 | B1 | 3/2007 | Hu |
| 7,216,569 | B2 | 5/2007 | Abdelgany |
| 7,237,463 | B1 | 7/2007 | Lee |
| D548,464 | S | 8/2007 | Lin |
| D549,069 | S | 8/2007 | Lin et al. |
| 7,281,454 | B2 | 10/2007 | Johnson et al. |
| 7,284,466 | B1 | 10/2007 | Ho |
| D557,099 | S | 12/2007 | Lin |
| 7,305,908 | B2 | 12/2007 | Chi |
| 7,409,894 | B1 | 8/2008 | Valentine |
| 7,467,574 | B1 | 12/2008 | Lin |
| 7,467,575 | B2 | 12/2008 | Lai |
| 7,565,852 | B2 | 7/2009 | Yu |
| 7,571,517 | B2 | 8/2009 | Smith et al. |
| 7,600,640 | B2 | 10/2009 | Hallee et al. |
| D604,509 | S | 11/2009 | Andrews |
| 7,698,972 | B2 | 4/2010 | Hi |
| 7,743,685 | B2 | 6/2010 | Chang |
| D622,125 | S | 8/2010 | Robinson |
| D623,037 | S | 9/2010 | Johnson et al. |
| 7,788,996 | B2 | 9/2010 | Johnson et al. |
| 7,810,415 | B2 | 10/2010 | Adamany et al. |
| 7,815,058 | B2 | 10/2010 | Cheng |
| 7,836,534 | B2 | 11/2010 | Simmons |
| 7,846,203 | B2 | 12/2010 | Cribier |
| 7,946,203 | B2 | 5/2011 | Johnson et al. |
| 8,011,277 | B2 | 9/2011 | Johnson et al. |
| 8,015,642 | B1 | 9/2011 | Oakley |
| 8,033,200 | B2 | 10/2011 | Johnson et al. |
| D650,257 | S | 12/2011 | Royes et al. |
| 8,336,428 | B2 | 12/2012 | Johnson et al. |
| 8,468,916 | B2 | 6/2013 | Johnson et al. |
| 8,613,121 | B1 | 12/2013 | White |
| 8,640,574 | B2 | 2/2014 | Johnson et al. |
| 2001/0005576 | A1 | 6/2001 | Roger et al. |
| 2001/0045145 | A1 | 11/2001 | Legg |
| 2003/0000902 | A1 | 1/2003 | Keis et al. |
| 2003/0047474 | A1 | 3/2003 | Dahlson |
| 2003/0126957 | A1 | 7/2003 | Huang |
| 2003/0136234 | A1 | 7/2003 | Cunningham |
| 2003/0188610 | A1 | 10/2003 | Lin |
| 2003/0226428 | A1 | 12/2003 | Liu |
| 2004/0050218 | A1 | 3/2004 | Napoli |
| 2004/0173061 | A1 | 9/2004 | Liou |
| 2004/0262344 | A1 | 12/2004 | White |
| 2005/0011318 | A1 | 1/2005 | Tsai |
| 2005/0199108 | A1 | 9/2005 | Jheng |
| 2005/0229752 | A1 | 10/2005 | Nickipuck |
| 2005/0247587 | A1 | 11/2005 | Holland-Letz |
| 2005/0268752 | A1 | 12/2005 | Johnson et al. |
| 2005/0268754 | A1 | 12/2005 | Fa |
| 2005/0284267 | A1 | 12/2005 | Liao et al. |
| 2006/0042428 | A1 | 3/2006 | Chuang |
| 2006/0101955 | A1 | 5/2006 | Chang |
| 2006/0118500 | A1 | 6/2006 | Chen |
| 2006/0150784 | A1 | 7/2006 | Hsieh |
| 2006/0213059 | A1 | 9/2006 | Eggert |
| 2006/0254396 | A1 | 11/2006 | Hu |
| 2006/0288531 | A1 | 12/2006 | Hu |
| 2006/0288823 | A1 | 12/2006 | Schepman |
| 2007/0023306 | A1 | 2/2007 | Lai |
| 2007/0044598 | A1 | 3/2007 | Frohm et al. |
| 2007/0056117 | A1 | 3/2007 | Gardiner et al. |
| 2007/0056872 | A1 | 3/2007 | Begim |
| 2007/0062831 | A1 | 3/2007 | Chen |
| 2007/0084740 | A1 | 4/2007 | Malek |
| 2007/0141885 | A1 | 6/2007 | Chen |
| 2007/0151402 | A1 | 7/2007 | Schneeman et al. |
| 2007/0186731 | A1 | 8/2007 | Schnarr et al. |
| 2007/0221017 | A1 | 9/2007 | Heaven |
| 2007/0228672 | A1 | 10/2007 | Huang |
| 2007/0245862 | A1 | 10/2007 | Gonzalez et al. |
| 2007/0295171 | A1 | 12/2007 | Johnson et al. |
| 2008/0128370 | A1 | 6/2008 | Shih |
| 2008/0148909 | A1 | 6/2008 | Lai |
| 2008/0156754 | A1 | 7/2008 | Cheng |
| 2008/0164171 | A1 | 7/2008 | Meng |
| 2008/0190249 | A1 | 8/2008 | Yu |
| 2008/0202963 | A1 | 8/2008 | Liao |
| 2008/0223179 | A1 | 9/2008 | Nash et al. |
| 2008/0251402 | A1 | 10/2008 | Chiu |
| 2008/0256816 | A1 | 10/2008 | Cosentino |
| 2008/0271573 | A1 | 11/2008 | Lown et al. |
| 2008/0295657 | A1 | 12/2008 | Cluthe |
| 2009/0107303 | A1 | 4/2009 | Steinweg et al. |
| 2009/0183604 | A1* | 7/2009 | Johnson ..... B25B 13/463 81/60 |
| 2009/0183608 | A1 | 7/2009 | Johnson et al. |
| 2009/0183609 | A1 | 7/2009 | Johnson et al. |
| 2009/0241740 | A1 | 10/2009 | Heagerty |
| 2010/0258465 | A1 | 10/2010 | Gomas |
| 2011/0000024 | A1 | 1/2011 | Johnson et al. |
| 2011/0094910 | A1 | 4/2011 | Fleury et al. |
| 2012/0012485 | A1 | 1/2012 | Wang |
| 2013/0228484 | A1 | 9/2013 | Yang |

FOREIGN PATENT DOCUMENTS

| | | | |
|---|---|---|---|
| CN | 2628230 | Y | 7/2004 |
| DE | 464002 | | 8/1928 |
| DE | 2035793 | B1 | 3/1972 |
| DE | 2453480 | A1 | 5/1976 |
| DE | 3744176 | A1 | 8/1988 |
| DE | 102004011892 | | 1/2005 |
| DE | 202004013404 | U1 | 3/2005 |
| DE | 20 2007 003841 | U1 | 9/2007 |
| EP | 856223 | | 12/1960 |
| EP | 503559 | A1 | 9/1992 |
| EP | 618046 | A1 | 10/1994 |
| EP | 01693163 | | 2/2006 |
| EP | 01777042 | | 4/2007 |
| FR | 787512 | | 9/1935 |
| JP | 55045442 | U | 3/1980 |
| JP | 57-13165 | | 1/1982 |
| JP | 61136778 | | 6/1986 |
| JP | 3-47775 | | 5/1991 |
| JP | 03103162 | | 10/1991 |
| JP | 4-29368 | | 3/1992 |
| JP | 5-31882 | | 4/1993 |
| JP | 08505812 | | 6/1996 |
| TW | I236402 | | 7/2005 |
| TW | M284496 | | 1/2006 |
| TW | M284500 | | 1/2006 |
| TW | M296765 | | 9/2006 |
| TW | I270445 | | 1/2007 |
| WO | 83/01406 | | 4/1983 |
| WO | 9412322 | A1 | 6/1994 |
| WO | 9623631 | | 8/1996 |
| WO | 97/29887 | | 8/1997 |

* cited by examiner

ADJUSTABLE TOOL HANDLE FOR HOLDING A TOOL DURING USE

FIELD OF THE INVENTION

The present invention relates to the field of hand held tools. More specifically, the present invention relates to the field of hexagonal and round wrenches and related tools and safety, comfort, and convenience of accessories and tools.

BACKGROUND OF THE INVENTION

Hexagonal wrenches or tool drivers, also referred to as allen wrenches or L-wrenches, have a hexagonal L-shaped body, including a long leg member and a short leg member. The end of either leg member is able to be inserted into a head of a screw or tool designed to accept a hexagonal wrench. Once inserted, rotational pressure is applied to the hexagonal wrench in order to tighten or loosen the screw. The leg members of the hexagonal wrench are designed to be of different lengths in order to allow a user flexibility when using the wrench in different environments and situations. For example, in a narrow, confined environment, the long leg of the hexagonal wrench is inserted into the head of the screw and the user will apply rotational pressure to the short leg. Or, if the environment is not so confined, the user is able to insert the short leg of the hexagonal wrench into the head of the screw and apply rotational pressure to the long leg.

Hexagonal wrenches are manufactured and distributed in multiple English and metric sizes in order to facilitate their use with screw heads of multiple sizes. Such wrenches are usually sold in a set which includes wrenches of multiple sizes but are also distributed individually.

When using a hexagonal wrench, a user, will insert an end of the hexagonal wrench into the head of a workpiece such as a screw, and will then exert rotational pressure on the opposite end of the wrench in order to tighten or loosen the screw. Because of the size and dimensions of the hexagonal wrench it is particularly difficult to exert a great amount of rotational pressure on the hexagonal wrench when the long leg of the hexagonal wrench is inserted into the head of the screw. Because the hexagonal wrench is typically turned with the user's fingers, the user is able to also experience scrapes and cuts from the use of hexagonal wrenches in this manner. Ingenuitive users have also used other tools, including vice grips, pliers and the like, to turn hexagonal wrenches. However, this method is disadvantageous because such tools are able to lose their hold on the hexagonal wrench when rotational pressure is applied or are able to even bend or otherwise disfigure the hexagonal wrench.

SUMMARY OF THE INVENTION

An adjustable tool handle for holding a tool during use provides an improved handling of tools during use of tools that are difficult to use on their own, specifically L-shaped hexagonal and round wrenches. The adjustable tool handle includes a tool handle body with a handle and an adjustable opening for receiving a tool. In order to place a tool within the tool handle, a user opens the tool handle and places the tool within the handle. After the tool is placed within the handle the tool is held in place by a holding component. The adjustable tool handle is able to hold a plurality of sizes of tools one at a time. Once the tool is positioned and held within the adjustable tool handle, a user is able to easily install or remove an object such as a screw with the benefit of a comfortable handle. The tool handle is also usable with a removable ratcheting mechanism. When the ratcheting mechanism is attached to the tool handle, the ratcheting mechanism couples with a plurality of bits or sockets of different sizes and types.

In one aspect, a tool handle for holding a tool during use comprises a body having a first end and a second end, an adjustable opening for receiving one of a plurality of tools of different sizes, and a retaining component that holds the tool in the adjustable opening during use, wherein an operable end of the tool extends from the first end or the second end of the tool handle during use. In some embodiments, the second end comprises an ergonomically shaped handle portion for holding during use. In some embodiments, the tool is a hexagonal shaped tool or a round shaped tool having an L-shaped body including a long leg member and a short leg member. In some of these embodiments, the long leg member and the short leg member are each held by the retaining component. In some embodiments, the long leg member extends from the tool handle during use. In further embodiments, the tool handle further comprises a ratcheting mechanism. In some of these embodiments, the ratcheting mechanism removably attaches to a first end of the handle. In further embodiments, the ratcheting mechanism removably attaches to a side of the handle. In some embodiments, the ratcheting mechanism removably receives one of a plurality of bits or sockets, each sized to fit a different sized work piece. In some embodiments, the ratcheting mechanism removably receives one or more of a hexagonal bit, a flathead bit, a phillips head bit, a square head bit, a star head bit, and other shaped bits. In further embodiments, the retaining component is manually moved from a closed position to an open position in order to place the tool within the adjustable opening and is manually retracted back to the closed position in order to hold the tool within the opening. In still further embodiments, the tool handle comprises a lock.

In another aspect, a tool set comprises a tool handle for removably holding one of a plurality of sized tools during use and a ratcheting mechanism that detachably couples to the tool handle, and is held in an adjustable opening of the tool handle, and wherein the ratcheting mechanism separately holds one of a plurality of bits or sockets during use. In some embodiments, the tool handle comprises a body having a first end and a second end, the adjustable opening for receiving the one of a plurality of tools of different sizes, and a retaining component that holds the tool in the opening during use. In some embodiments, the one of a plurality of tools is a hexagonal shaped tool or a round shaped tool having an L-shaped body including a long leg member and a short leg member. In further embodiments, the retaining component is manually moved from a closed position to an open position in order to place the tool within the adjustable opening and is manually retracted back to the closed position in order to hold the tool within the opening. In some embodiments, the ratcheting mechanism removably attaches to the first end of the handle. In further embodiments, the ratcheting mechanism removably attaches to a side of the handle. In some embodiments, the ratcheting mechanism removably receives one of a plurality of bits or sockets, each sized to fit a different sized work piece. In some embodiments, the ratcheting mechanism removably receives one or more of a hexagonal bit, a flathead bit, a phillips head bit, a square head bit, a star head bit, and other shaped bits. In further embodiments, the tool handle comprises a lock.

In a further aspect, a method of utilizing an adjustable tool handle for holding a plurality of different sized tools comprises moving a retaining component to an open position, placing a tool within an adjustable opening of the tool handle, and moving the holding component to a closed position and holding the tool within the adjustable opening of the tool handle, wherein the tool extends from the first end or the second end of the tool handle during use. In some embodiments, the retaining component is moved to the open position by moving a slidable button. In further embodiments, moving the retaining component to a closed position comprises releasing the slidable button. In some embodiments, the tool is a hex wrench having an L-shaped body including a long leg member and a short leg member. In further embodiments, the tool is a ratcheting mechanism. In some of these embodiments, the ratcheting mechanism removably receives one of a plurality of bits or sockets, each sized to fit a different sized work piece. In further embodiments, the ratcheting mechanism removably receives one or more of a hexagonal bit, a flathead bit, a phillips head bit, a square head bit, a star head bit, and other shaped bits. In some embodiments, the tool handle comprises a lock.

DETAILED DESCRIPTION OF THE PREFERRED EMBODIMENT

An adjustable tool handle provides an improved handle for turning a tool such as a hexagonal or a round wrench.

Figure 1:
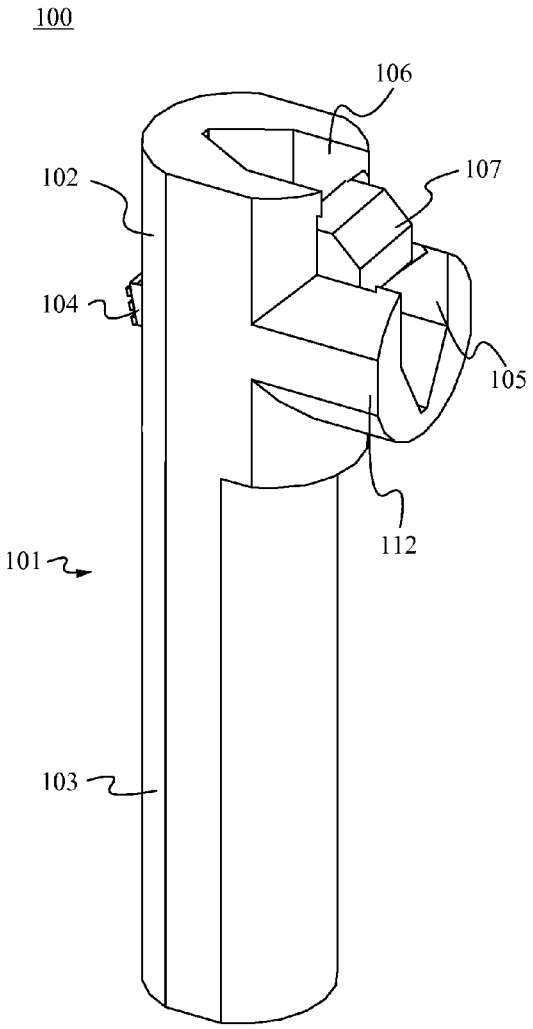
FIG. 1 illustrates a side perspective view of an adjustable tool handle for holding a tool during use in accordance with some embodiments.

Referring now to FIG. 1, a side perspective view of an adjustable tool handle for holding a tool during use is depicted therein. The tool handle 100 comprises a tool handle body 101 having a first end 102, a second end 103, an opening 106, a slidable button 104, and a retaining component 107. As shown in FIG. 1, the tool handle 100 also comprises an arm 112 and an opening 105. As further shown in FIG. 1, the opening 106 and the opening 105 comprise a rectangular shaped channel with a v-shaped bottom to the channel. However, the opening 106 and the opening 105 are able to comprise any shaped opening as known in the art and compatible with holding a tool. As described further below, the slidable button is moved in an upward direction in order to move the retaining component 107 and insert a tool. In FIG. 1, the retaining component 107 is located within the opening 106 and the opening 105. In some embodiments, the second end 103 of the tool handle 100 is ergonomically shaped so as to comfortably fit within a hand of a user. In some embodiments, the second end 103 of the tool handle 100 is rubber and/or textured in order to enable a user to easily grip the tool handle 100.

Figure 2:
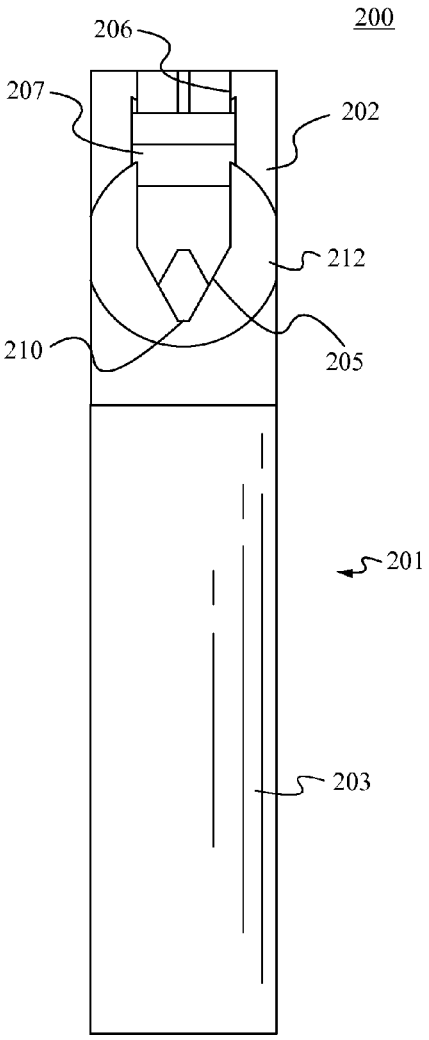
FIG. 2 illustrates a front view of an adjustable tool handle for holding a tool during use in accordance with some embodiments.

FIG. 2 illustrates a front view of an adjustable tool handle for holding a tool during use. The front view shows the tool handle 200 comprising a body 201 having a first end 202, a second end 203, an opening 206, and a retaining component 207. The tool handle 200 also comprises an arm 212 and an opening 205 with an adjustable aperture 210 between the v-shaped bottom of the opening 205 and the retaining component 207.

Figure 3:
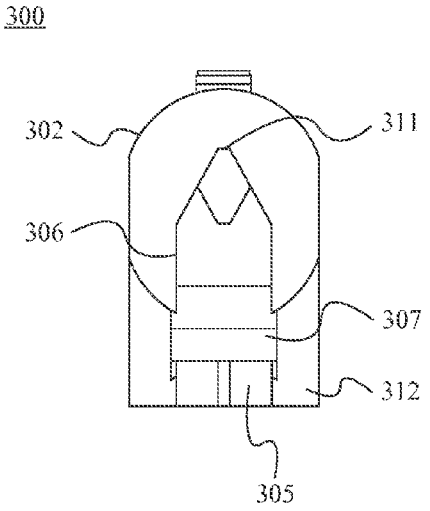
FIG. 3 illustrates a top view of an adjustable tool handle for holding a tool during use in accordance with some embodiments.

FIG. 3 illustrates a top view of an adjustable tool handle for holding a tool during use. The top view shows the tool handle 300 comprising a body having a first end 302, an opening 306, and a retaining component 307. The tool handle 300 also comprises an arm 312 and an opening 305. As shown within FIG. 3, there is an adjustable aperture 311 between the v-shaped bottom of the opening 306 and the retaining component 307.

Figure 4:
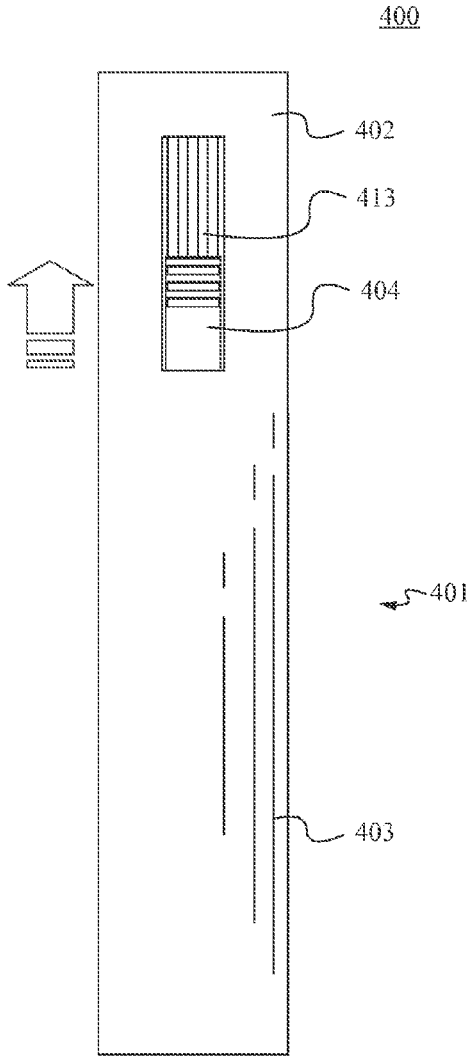
FIG. 4 illustrates a back view of an adjustable tool handle for holding a tool during use in accordance with some embodiments.

FIG. 4 illustrates a back view of the adjustable tool handle for holding a tool during use. The back view shows a tool handle 400 comprising a body 401 having a first end 402, a second end 403, and a slidable button 404. As shown in FIG. 4, the slidable button 404 is located within a track 413. A user is able to push the button 404 from a bottom of the track 413 to a top of the track 413 as indicated by the arrow. As described below, when the slidable button 404 is pushed from the bottom of the track 413 to the top of the track 413 the retaining component is pushed in an upward and outward direction enabling a tool to be removably coupled with the tool handle 400. In some embodiments, the slidable button 404 automatically retracts from the top end of the track 413 to the bottom end of the track 413 when no pressure is applied to the slidable button 404. In some embodiments, the slidable button 404 is manually pushed to the bottom of the track 413.

Figure 5:
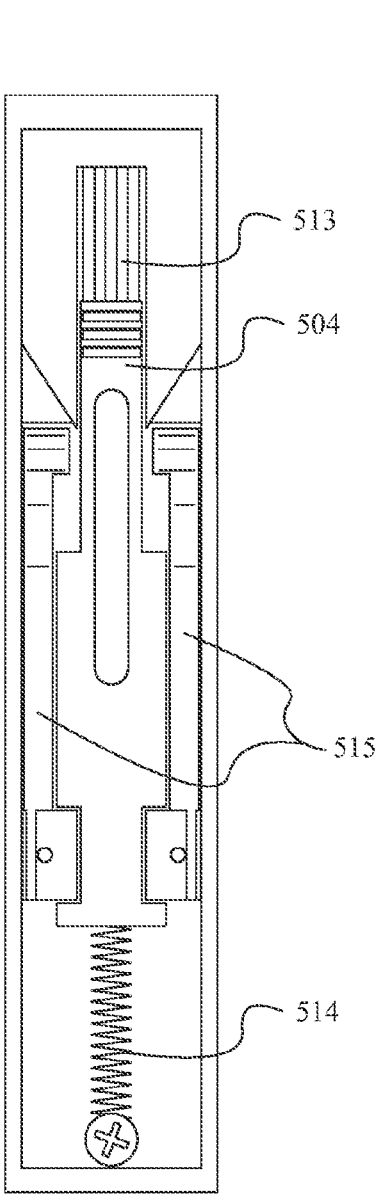
FIG. 5 illustrates a back view of the adjustable tool handle for holding a tool during use with the back cover removed in accordance with some embodiments.

FIG. 5 illustrates a back view of the adjustable tool handle for holding a tool during use with the back cover removed in order to illustrate the mechanism of the slidable button 504 and the retaining component. The back view shows the tool handle 500 with a slidable button 504 located within the track 513. The slidable button 504 is pushed from a bottom to a top of the track 513 in order to removably couple a tool with the tool handle. In some embodiments, the slidable button 504 is attached to a return mechanism 514. In some embodiments, the return mechanism 514 biases the slidable button 504 towards a bottom end of the track 513.

As also shown in FIG. 5, the slidable button 504 is fixedly connected to a pair of resilient members 515. The resilient members 515 are connected to the slidable button 504 at one end and to the retaining component at a second end. When a user pushes the slidable button 504 in an upward direction, the resilient members 515 move in an upward direction and push the retaining component upward and outward from the openings, as described above, and as further described below. In some embodiments, the resilient members 515 comprise non-stretchable plastic members. In some embodiments, the resilient members 515 comprise aluminum or a metal alloy. As will be apparent to someone of ordinary skill in the art, the resilient members are able to comprise any appropriate material as known in the art capable of moving the retaining component in an upward and outward direction. As the slidable button 504 is retracted so are the resilient members 515 and the retaining component is drawn inward and to a closed position where it rests within the openings of the tool handle 500.

Figure 6A:
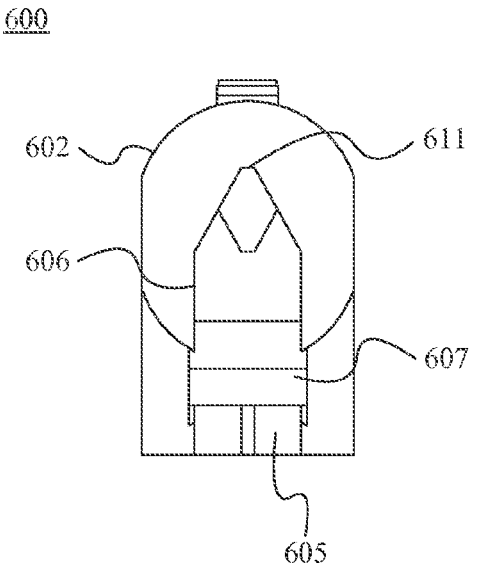
FIGS. 6A and 6B illustrate a top view of the operation of a retaining component of the adjustable tool handle for holding a tool during use in accordance with some embodiments.
Figure 6B:
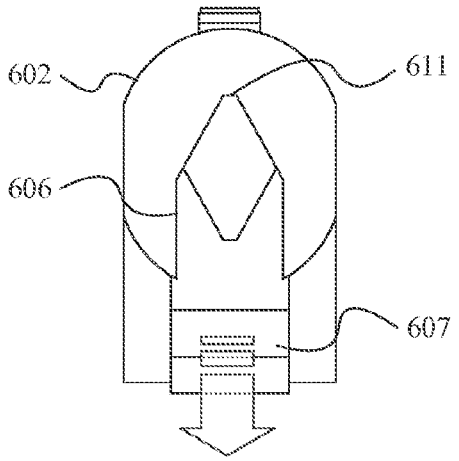

FIGS. 6A and 6B illustrate a top view of the operation of the retaining component 607 as it moves from a closed position where it is located within the opening 605 and the opening 606 to an open position where the retaining component 607 is pushed upward and outward from the openings by operation of the slidable button and resilient member, as described above. As shown in FIG. 6A, the retaining mechanism 607 is in a closed position and located within the opening 605 and the opening 606. In this position, the adjustable aperture 611 is in a first position. As described above, when the slidable button is pushed upward, the retaining component 607 is pushed in an upward and outward direction to an open position. FIG. 6B shows the retaining component 607 in an open position. When the retaining component 607 is moved to the open position, the adjustable aperture 611 moves to a second position that enables a user to insert a tool within the tool handle. By moving the slidable button, a user is able to move the retaining component 607 to a plurality of positions and change the size of the aperture 611. Consequently, the aperture 611 is able to fit a variety of sized tools.

Figure 7A:
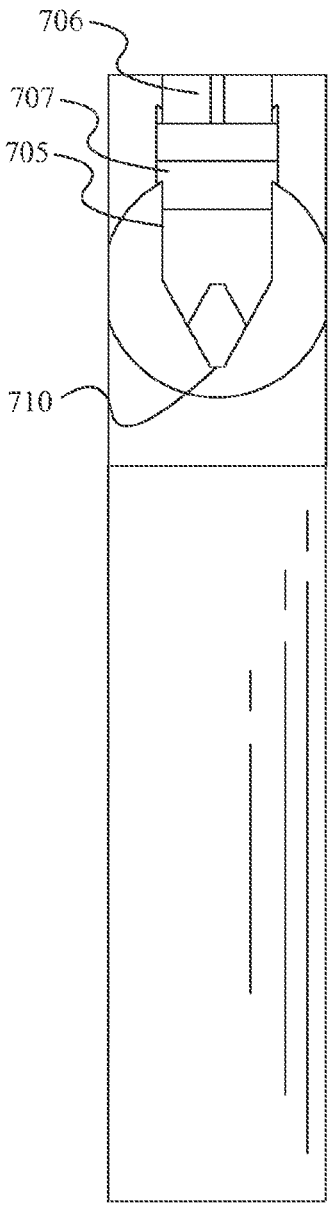
FIGS. 7A and 7B illustrate a front view of the operation of a retaining component of the adjustable tool handle for holding a tool during use in accordance with some embodiments.
Figure 7B:
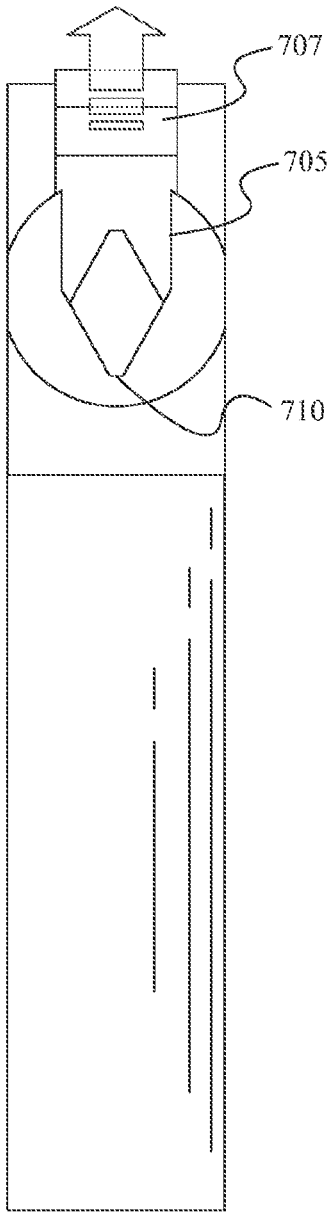

Similarly, FIGS. 7A and 7B illustrate a front view of the operation of the retaining component 707 as it moves from a closed position where it is located within the opening 705 and the opening 706 to an open position where the retaining component 707 is pushed upward and outward from the openings by operation of the slidable button and resilient member, as described above. As shown in FIG. 7A, the retaining mechanism 707 is in a closed position and located within the opening 705 and the opening 706. In this position, the adjustable aperture 710 is in a first position. As described above, when the slidable button is pushed upward, the retaining component 707 is pushed in an upward and outward direction to an open position. FIG. 7B shows the retaining component 707 is in an open position. When the retaining component 707 is moved to the open position, the adjustable aperture 710 moves to a second position that enables a user to insert a tool within the tool handle. By moving the slidable button, a user is able to move the retaining component 707 to a plurality of positions and change the size of the aperture 710. Consequently, the aperture 710 is able to fit a variety of sized tools.

Figure 8A:
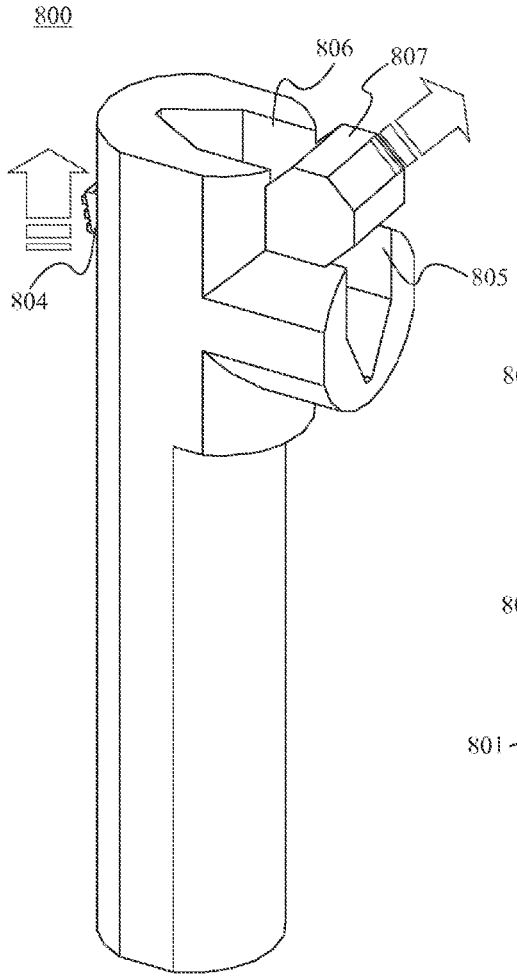
FIGS. 8A-8C illustrate a side perspective view of an adjustable tool handle for holding a tool during use with the retaining component in an open position in accordance with some embodiments.

FIG. 8A illustrates a tool handle with the retaining component 807 pushed in an upward and outward direction and to the open position. With the retaining component 807 in an open position, a user is able to removably couple a L-shaped hexagonal or round tool with the tool handle 800. As described above, the retaining component 807 is moved to the open position by pushing the slidable button 804 in an upward direction.

Figure 8B:
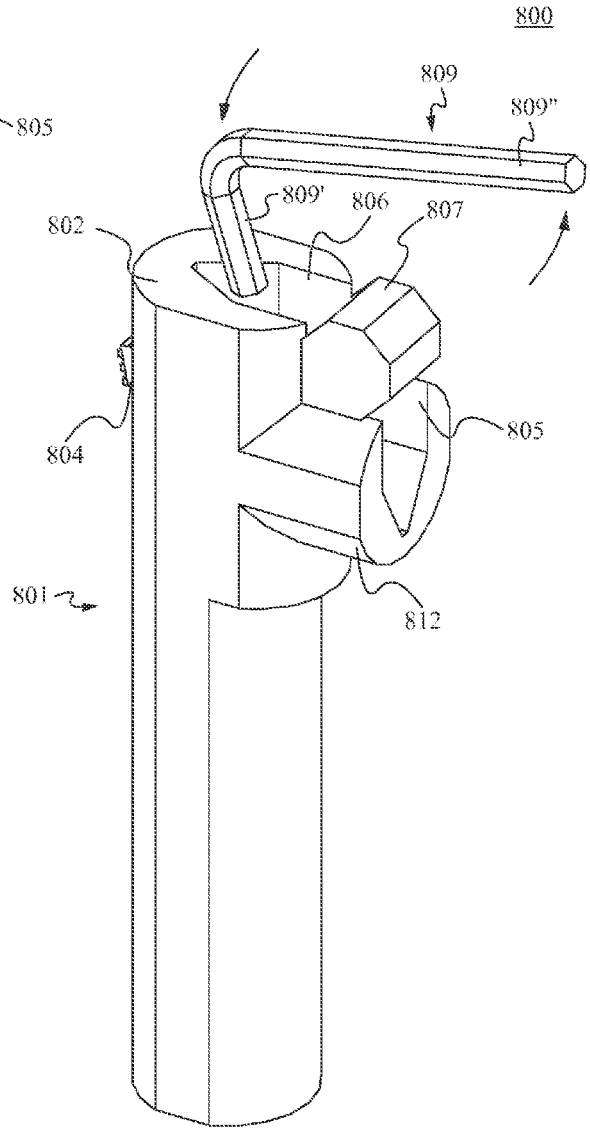

As shown within FIG. 8B, in order to position a tool 809 so that the tool extends from the first end 802 of the tool handle 800 during use, a short leg 809' of the tool 809 is inserted into the opening 806. After inserting the short leg 809' of the tool 809 into the opening 806, the tool 809 is turned in an upward direction so that the short leg 809' rests within and is parallel to the opening 805 and the long leg 809" is parallel to and rests within the opening 806. When the slidable button 804 is returned, the retaining component 807 retracts and securely holds the tool 809 within the body 801 of the tool handle 800 with the long leg 809" extending from the first end 802 of the tool handle 800 and in an operative position.

Figure 8C:
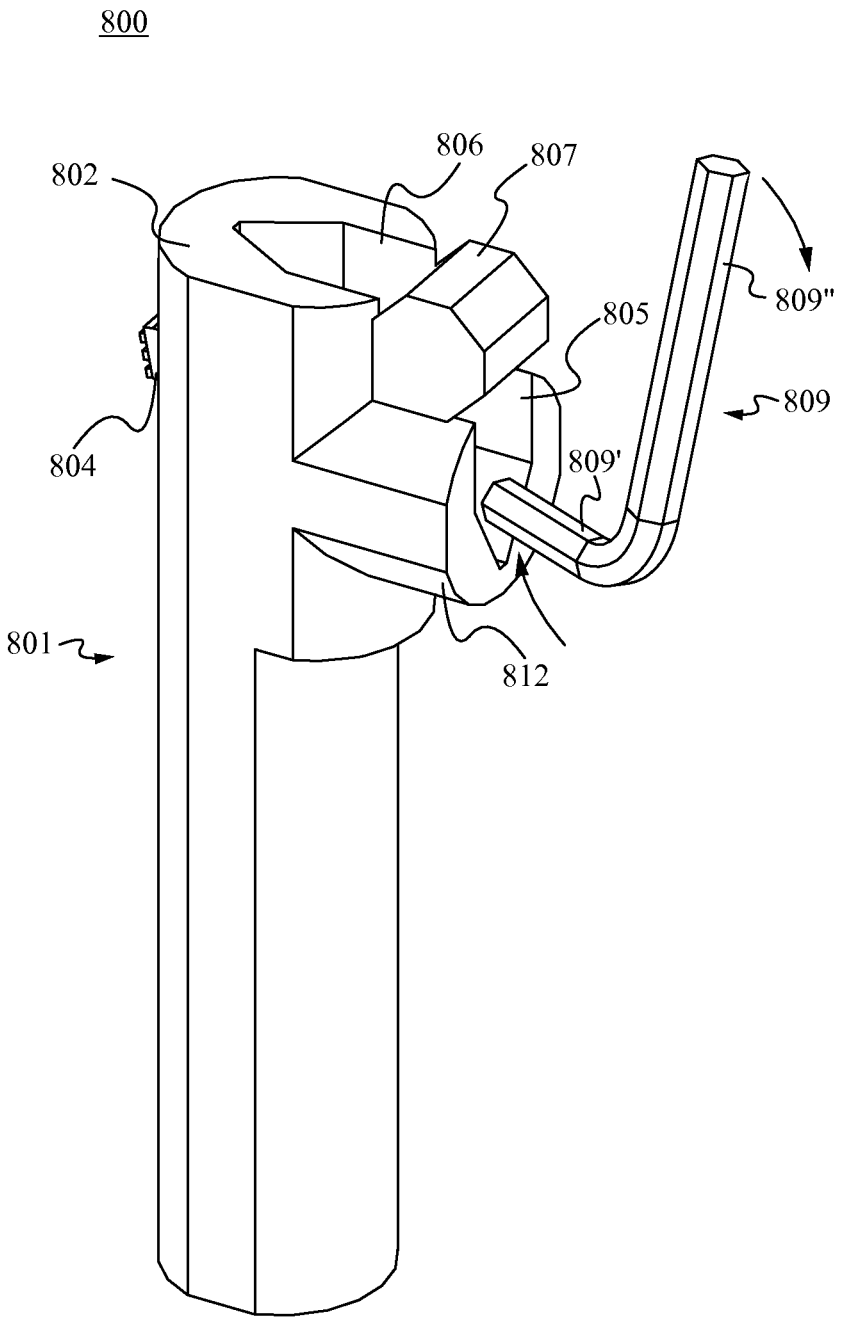

As shown within FIG. 8C, in order to position a tool 809 so that the tool extends from the side of the tool handle 800 during use, a short leg 809' of the tool 809 is inserted into the opening 805. After inserting the short leg 809' of the tool 809 into the opening 805, the tool 809 is turned in a downward direction so that the short leg 809' rests within and is parallel to the opening 806 and the long leg 809" is parallel to and rests within the opening 805. When the slidable button 804 is released and the retaining component 807 is retracted the tool 809 is securely held within the body 801 of the tool handle 800 with the long leg 809" extending from the arm 812 of the tool handle 800 and in an operative position.

As described above, the openings comprise a rectangular shaped channel with a v-shaped bottom. When an L-shaped hexagonal or round tool is placed within the tool handle, the retaining component pushes the tool to the bottom of the openings so that the tool is confined within the v-shaped bottom. In this manner, the tool handle is able to hold multiple tools of different sizes. Specifically, as the size of the tool decreases, it is pushed farther into the v-shaped bottom of the openings. The retaining component pushes on the long leg member and the short leg member of the tool and securely confines the tool within the groove of the arm and the body of the tool handle. This arrangement also allows for the tool to be positioned as close to an end of the handle as possible in order to maximize the leverage and turning power of the tool.

Figure 9A:
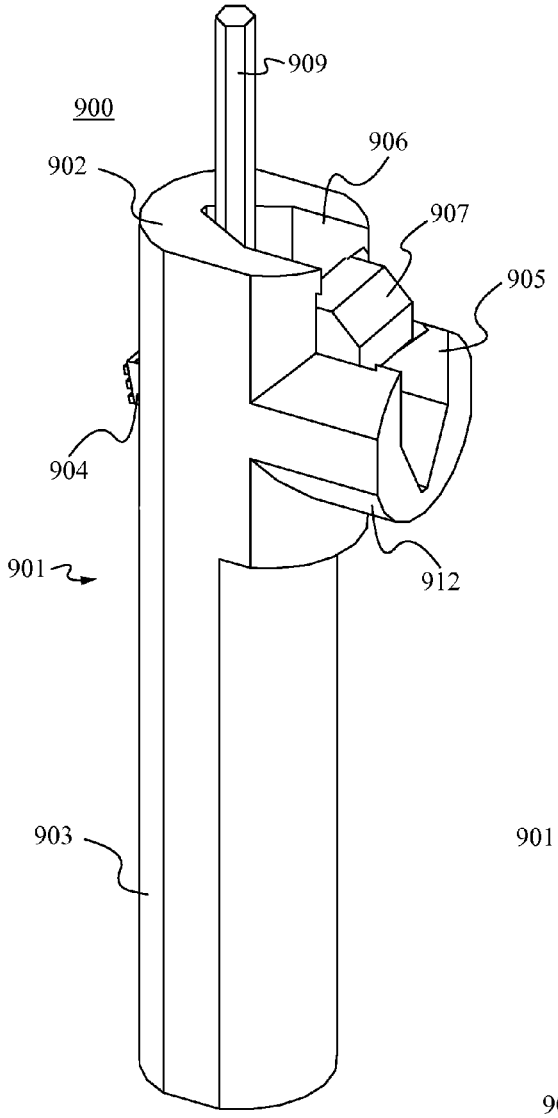
FIGS. 9A and 9B illustrate a side perspective view of an adjustable tool handle for holding a tool during use in accordance with some embodiments.
Figure 9B:
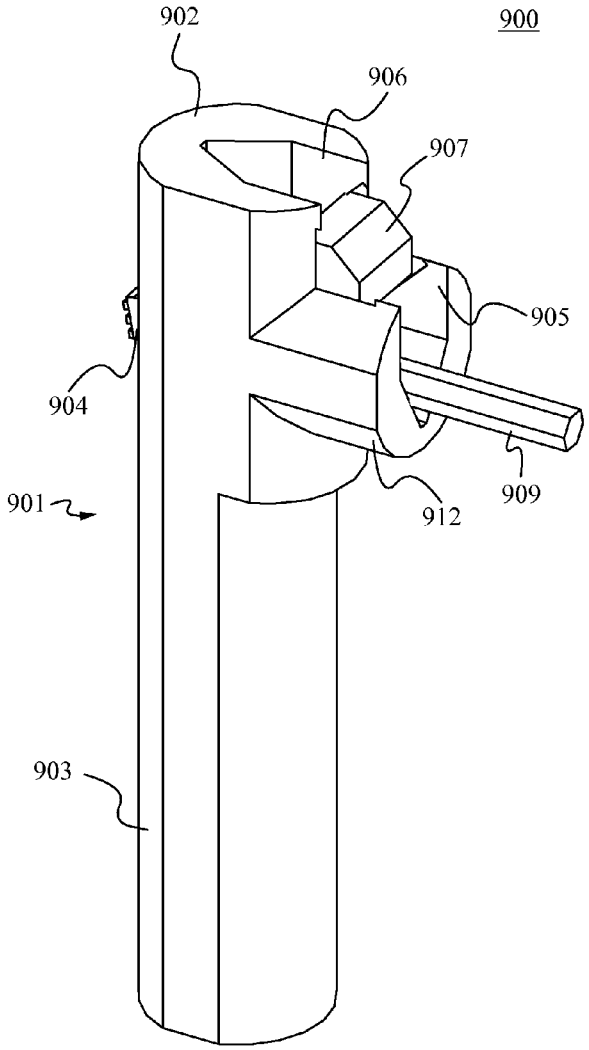

FIGS. 9A and 9B illustrate a side perspective view of the adjustable tool handle holding a L-shaped hexagonal or round tool. As shown in FIG. 9A, a tool 909 extends from the first end 902 of the tool handle 900, as described above with reference to FIG. 8B. FIG. 9B shows the tool extending from the arm 912 of the tool handle 900, as described above with reference to FIG. 8B. As described above, when the tool 909 is secured within the tool handle 900 it is securely held within the v-shaped bottom of the opening 906 and the opening 905 by the retaining component 907. When the tool 909 is securely held within the tool handle 900, a user is able to easily install or remove an object such as a screw with the benefit of a comfortable handle. In some embodiments, the second end 903 of the tool handle 900 is ergonomically shaped so as to comfortably fit within a hand of a user. In some embodiments, the second end 903 of the tool handle 900 is rubber and/or textured in order to enable a user to easily grip the tool handle 900.

In some embodiments, the adjustable tool handle for holding a tool during use is designed to be utilized with hexagonal wrenches of English sizes including a 9/32 inch hexagonal wrench, a 1/4 inch hexagonal wrench, a 7/32 inch hexagonal wrench, a 3/16 inch hexagonal wrench, a 5/32 inch hexagonal wrench, a 9/64 inch hexagonal wrench, a 1/8 inch hexagonal wrench, a 7/64 inch hexagonal wrench, a 3/32 inch hexagonal wrench and a 5/64 inch hexagonal wrench.

In some embodiments, the adjustable tool handle for holding a tool during use is also designed to be utilized with hexagonal wrenches of metric sizes including a 10 mm hexagonal wrench, an 8 mm hexagonal wrench, a 6 mm hexagonal wrench, a 5 mm hexagonal wrench, a 4.5 mm hexagonal wrench, a 4 mm hexagonal wrench, a 3.5 mm hexagonal wrench, a 3 mm hexagonal wrench, a 2.5 mm hexagonal wrench and a 2 mm hexagonal wrench. It should be apparent to one skilled in the art that a universal ratcheting tool 100 is able to be formed to hold fewer, additional or different sizes of hexagonal wrenches.

Alternatively, the adjustable tool handle for holding a tool during use is able to be used with tools other than hexagonal wrenches. For example, a flat screwdriver is able to be used with the tool handle by including it on the end of a hexagonal L-shaped tool. Alternatively, a phillips screwdriver is also able to used with the tool handle by also including it on the end of a hexagonal L-shaped tool. Particularly, the tool handle for holding a tool during use is able to be used with any appropriate tool as known in the art. For example, in some embodiments, the tool handle is used with tools including a square head screwdriver, a star head screwdriver, and other tools.

Figure 10A:
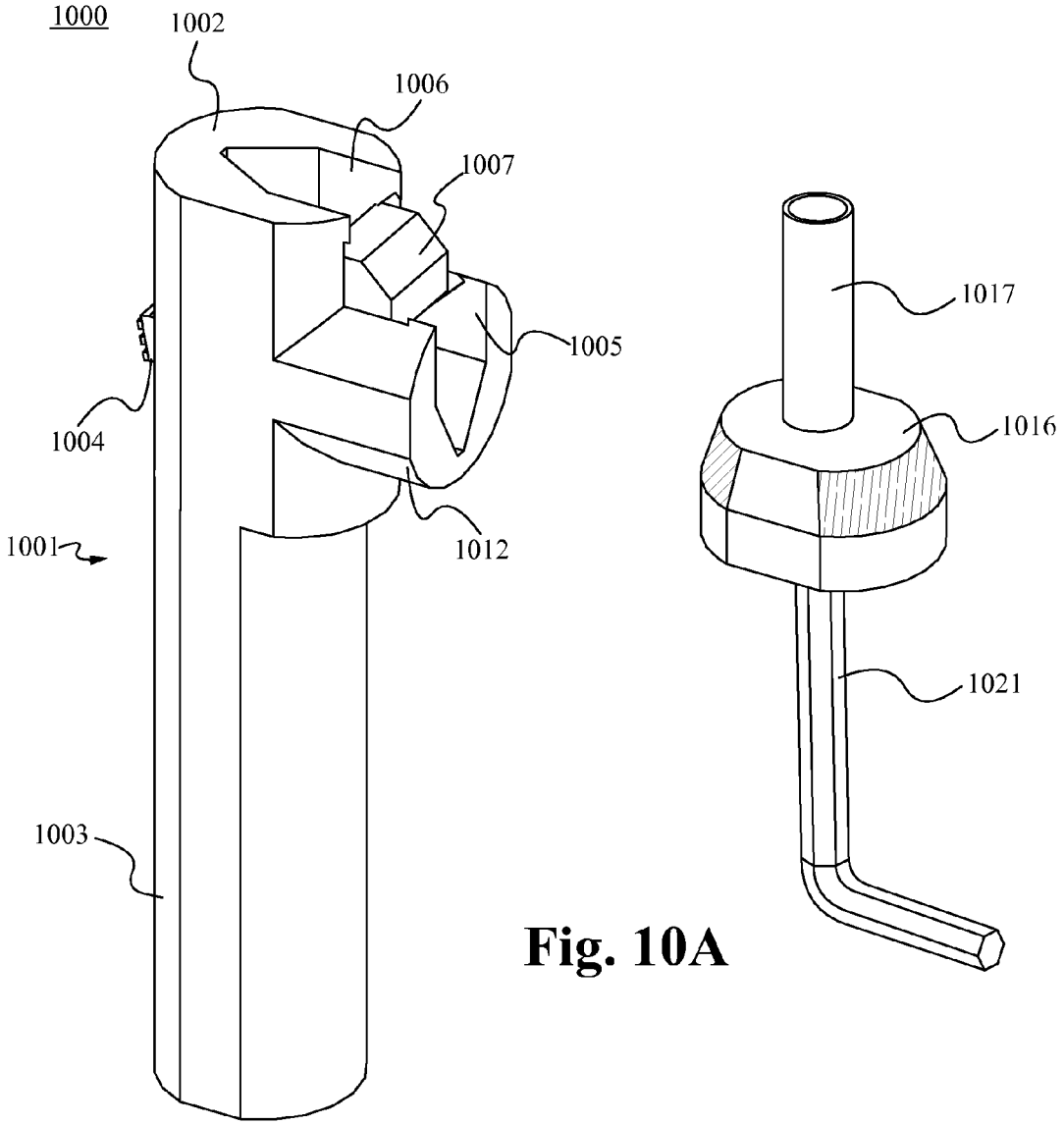
FIGS. 10A-10D illustrate a side perspective view of an adjustable tool handle for holding a tool during use in accordance with some embodiments.

In some embodiments, the adjustable tool handle for holding a tool during use is able to be coupled with a ratcheting mechanism. FIGS. 10A-10D illustrate a tool set including an adjustable tool handle 1000 for holding a tool during use and a ratcheting mechanism 1016 in accordance with some embodiments. The adjustable tool handle 1000 for holding a tool during use is similar to the handle as described above, and comprises a tool handle body 1001 having a first end 1002, a second end 1003, an opening 1006, a slidable button 1004, and a retaining component 1007. As shown in FIG. 10A, the tool handle 1000 also comprises an arm 1012 with an opening 1005. As further shown in FIG. 10A, the opening 1006 and the opening 1005 comprise a rectangular shaped channel with a v-shaped bottom. However, the opening 1006 and the opening 1005 are able to comprise any shaped opening as compatible with holding a tool. The retaining component 1007 is located within the opening 1006 and the opening 1005.

As also shown in FIG. 10A, the ratcheting mechanism 1016 comprises a coupling mechanism 1021 for removably coupling with the tool handle 1000 and a stem portion 1017 for removably coupling with an additional tool. In some embodiments, the ratcheting mechanism 1016 removably couples to the handle 1000 by a snap-fit or a screw fit. However, as will be apparent to someone of ordinary skill in the art, the ratcheting mechanism 1016 is able to couple with the tool handle 1000 by any mechanism as known in the art. For example, in some embodiments, the coupling mechanism 1021 is a L-shaped hexagonal or round tool and the ratcheting mechanism 1016 couples to the handle 1000 in the same manner as a L-shaped hexagonal or round tool, as described above.

Figure 10B:
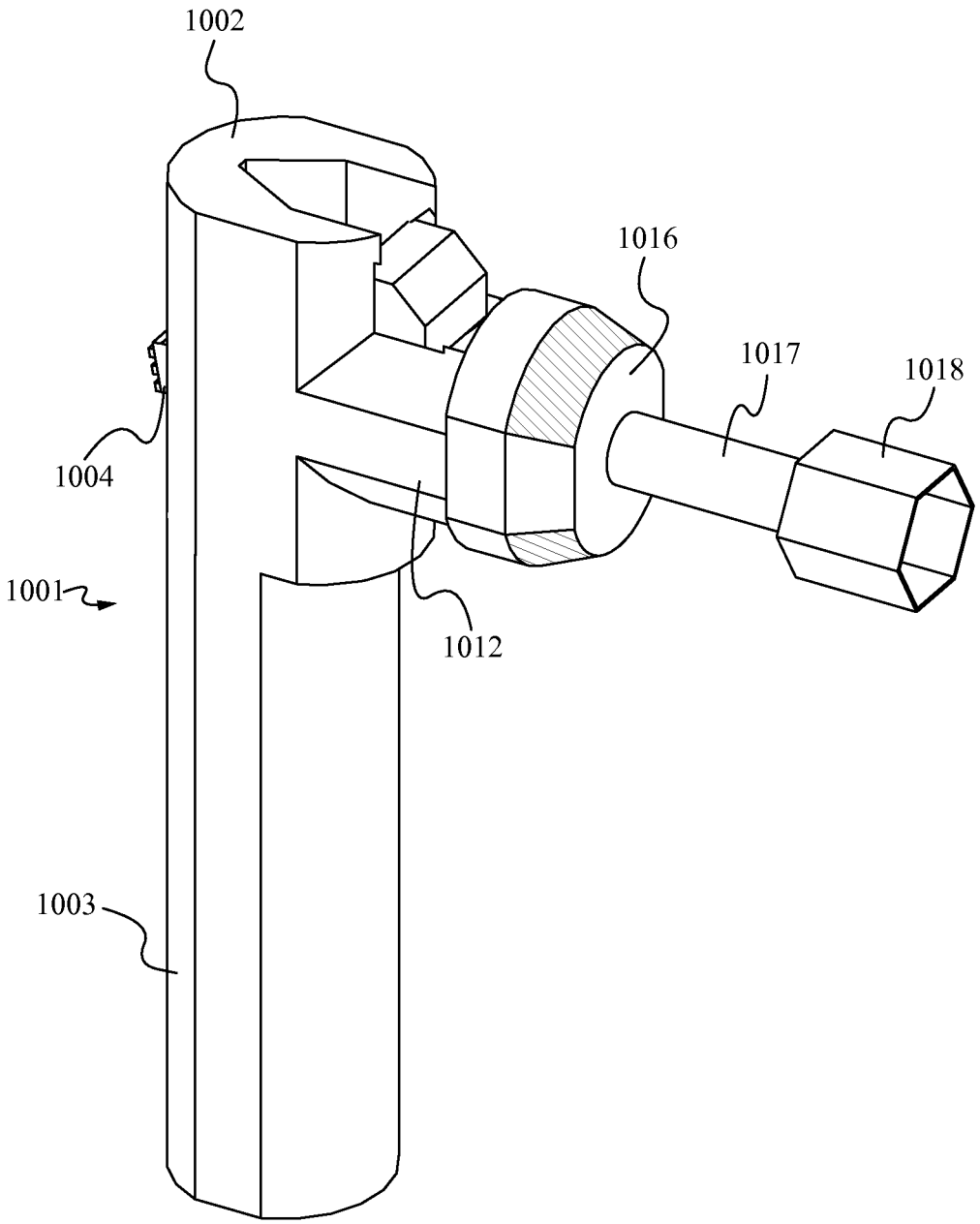
Figure 10C:
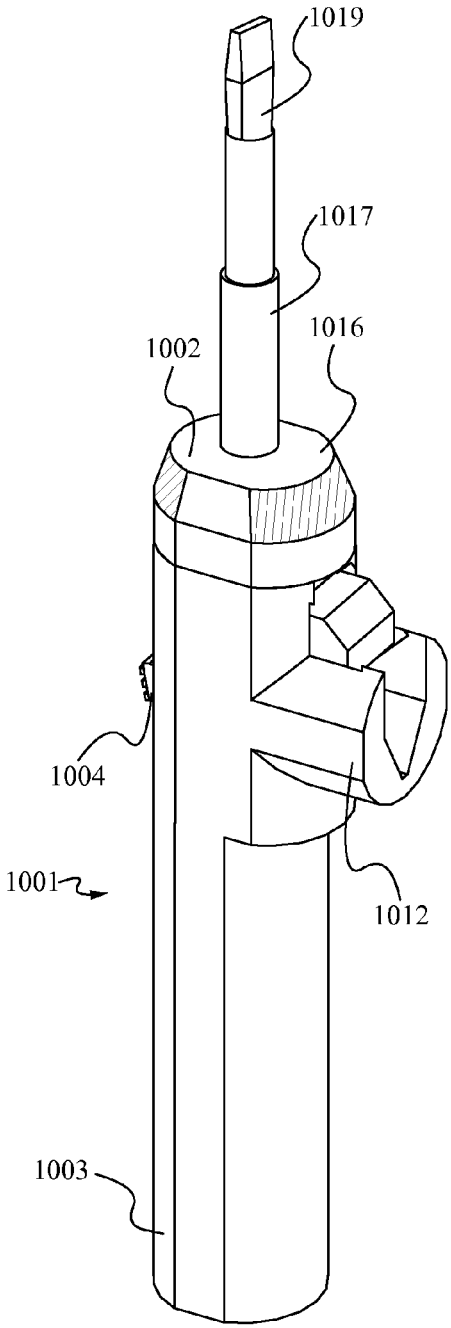
Figure 10D:
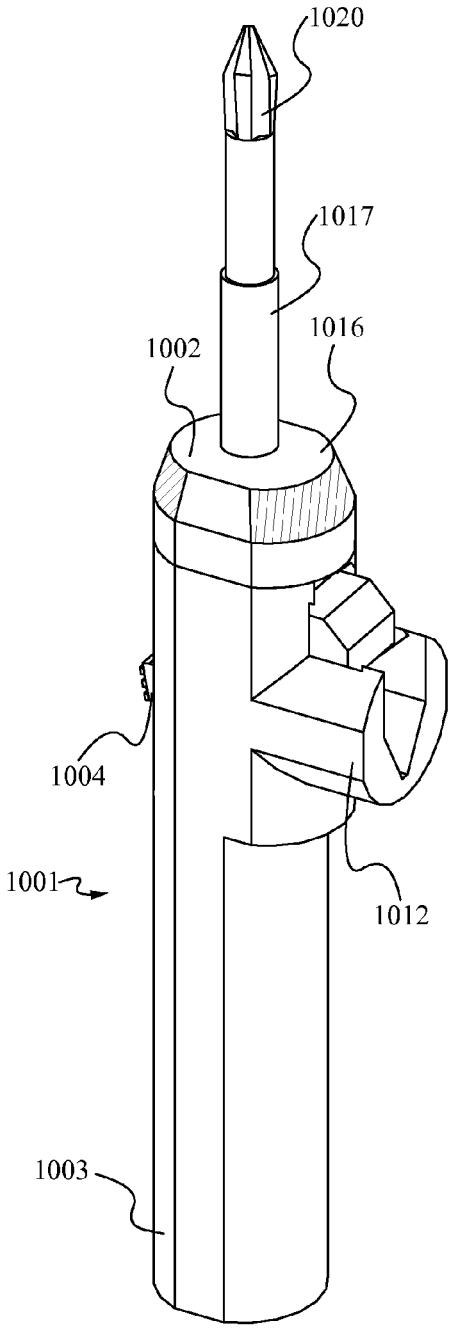

In some embodiments, the ratcheting mechanism 1016 couples to a side of the tool handle 1000. FIG. 10B shows a ratcheting mechanism 1016 coupled to an arm 1012 of a tool handle body 1001 in accordance with some embodiments. As further shown within FIG. 10B, the stem 1017 is coupled to a socket 1018. The stem 1017 is able to couple to bits of different sizes and types in order to tighten or loosen nuts and bolts of different sizes and types. Alternatively, as shown in FIG. 10C, the ratcheting mechanism 1016 is able to couple to the first end 1002 of the tool handle 1000. Additionally, as also shown in FIG. 10C the ratcheting mechanism 1016 is able to be used with other tools such as a flat head screwdriver 1019. Further, as shown in FIG. 10D, in some embodiments, the ratcheting mechanism 1016 is able to be used with other tools such as a phillips head screwdriver 1020. Alternatively, in some embodiments, the ratcheting mechanism 1016 is able to be used with a hexagonal or round tool. As will be apparent to someone of ordinary skill in the art, the ratcheting mechanism is able to be used with any appropriate tool. The ratcheting mechanism is able to be configured either clockwise or counterclockwise so that the ratchet mechanism allows the tool to be turned in the specified direction which enables the user to either install or remove an object. In some embodiments, this is done by twisting the ratcheting mechanism.

Figure 11:
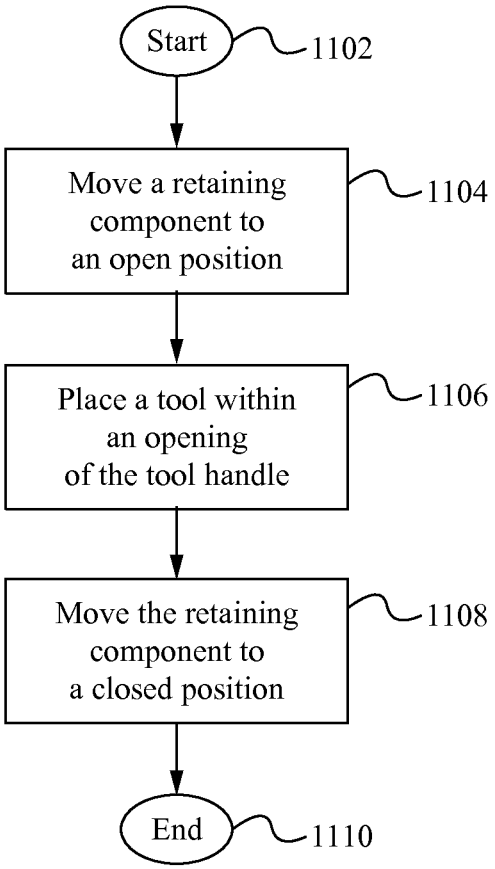
FIG. 11 illustrates a method of utilizing an adjustable tool handle for holding one of a plurality of different sized tools during use in accordance with some embodiments.

FIG. 11 illustrates a method of utilizing an adjustable tool handle for holding one of a plurality of different sized tools during use. As shown in FIG. 11, in the step 1104, a retaining component is moved to an open position. As described above, in some embodiments, the retaining component is moved to the open position by pushing a slidable button in an upward direction. However, the retaining mechanism is able to be moved to the open position by any appropriate mechanism as known in the art. In the step 1106, a tool is placed within an opening of the tool handle. Then, in the step 1108, the retaining component is moved to a closed position and the tool is securely held within the tool handle and in an operative position.

Figure 12:
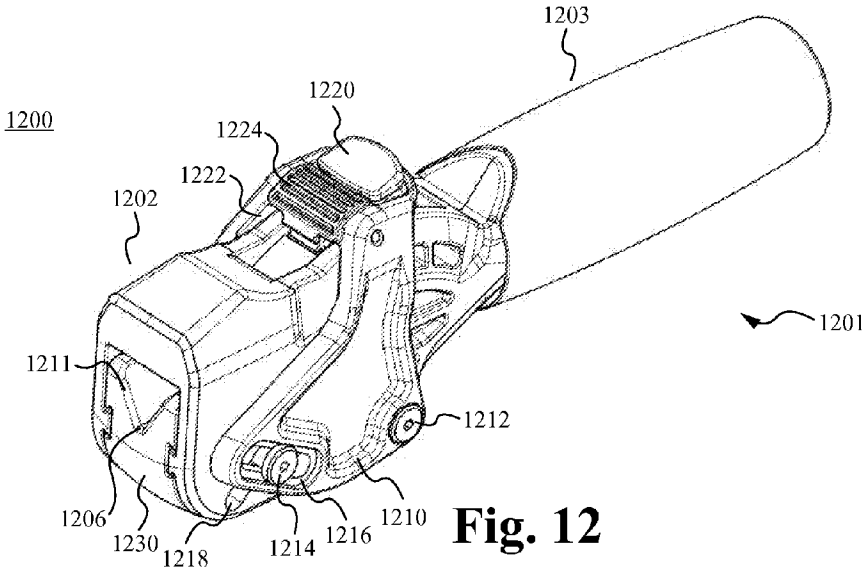
FIG. 12 illustrates a left side perspective view of an adjustable tool handle for holding a tool during use in accordance with some embodiments.

Referring now to FIG. 12, a left side perspective view of an adjustable tool handle for holding a tool during use in accordance with further embodiments, is depicted therein. The tool handle 1200 comprises a tool handle body 1201 having a first end 1202 and a second end 1203, an adjustment mechanism 1210, a retaining component 1230, and an opening 1206. As shown in FIG. 12, the opening 1206 comprises a rectangular shaped channel with a v-shaped bottom to the channel. However, the opening 1206 is able to comprise any shaped opening as known in the art and compatible with holding a tool. In some embodiments, the opening 1206 comprises an adjustable aperture 1211. In some embodiments, the tool handle 1200 is configured for holding an L-shaped hexagonal or round tool. In some embodiments, the second end 1203 of the tool handle is ergonomically shaped so as to comfortably fit in the hand of a user. In some embodiments, the second end of the tool handle 1203 is rubber and/or texturized in order to enable a user to easily grip the tool handle 1200.

As further shown in FIG. 12, the adjustment mechanism 1210 comprises a pivot pin 1212, an adjustment pin 1214, a track 1216, and a button 1220. The adjustment pin 1214 is configured to move within the track 1216 of the adjustment mechanism 1210 and the track 1218 of the first end 1202. The button 1220, the pivot pin 1212, the adjustment pin 1214 and the tracks 1216 and 1218 cooperate in order to move the retaining component 1230 in an upward and outward direction. More specifically, when the button 1220 is pushed in an upward direction towards the top of the track 1222, the adjustment mechanism 1210 pivots about the pivot pin 1212 and the adjustment pin 1214 moves within the track 1216 and the track 1218 and the retaining component 1230 is pushed in an upward and outward direction. When the retaining component 1230 is pushed in the upward and outward direction, the adjustable aperture 1211 gets bigger and a tool is able to be coupled with the tool handle 1200.

Figure 13:
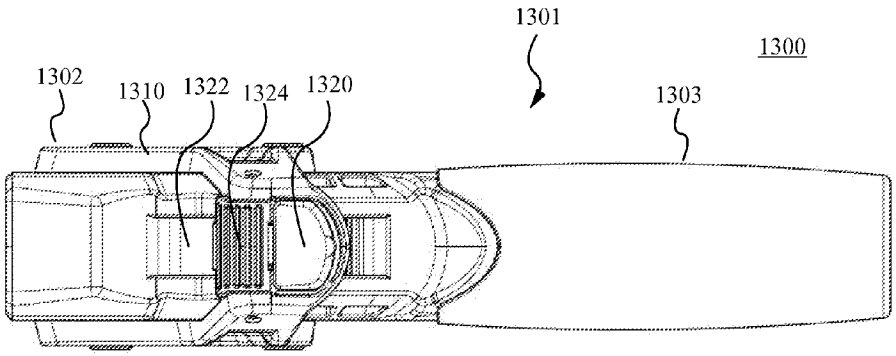
FIG. 13 illustrates a front view of an adjustable tool handle for holding a tool during use in accordance with some embodiments.

FIG. 13 illustrates a front view of the adjustable tool handle for holding a tool during use. The front view shows the tool handle 1300 comprising a body 1301 having a first end 1302, a second end 1303, and an adjustment mechanism 1310. The adjustment mechanism 1310 comprises a button 1320, a channel 1322 and a lock 1324. In some embodiments, a user is able to slide the button 1320 from a bottom to a top of the channel 1322. In some embodiments, a user is able to lock the button 1320 in place by setting the lock 1324. In some embodiments, the lock 1324 is locked when a user releases the button 1320 of the adjustment mechanism 1310.

Figure 14:
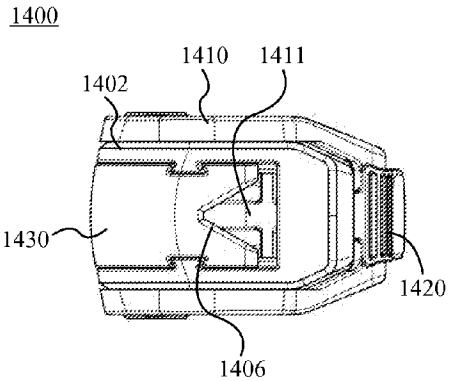
FIG. 14 illustrates a top view of an adjustable tool handle for holding a tool during use in accordance with some embodiments.

FIG. 14 illustrates a top view of an adjustable tool handle for holding a tool during use. The top view shows the tool handle 1400 comprising a body 1401 having a first end 1402, an opening 1406 and a retaining component 1430. As shown within FIG. 14, there is an adjustable aperture 1411 between the v-shaped bottom of the opening 1406. As described above and similar to the operation as described in relation to FIGS. 6A and 6B, when the retaining component 1430 is pushed in an upward and outward direction, the adjustable aperture 1411 moves to a second position to enable a user to couple a tool with the tool handle. By pushing the button 1220 (FIG. 12), a user is able to move the retaining component 1430 to a plurality of positions and change the size of the aperture 1411. Consequently, the aperture 1411 is able to fit a variety of sizes of tools.

Figure 15:
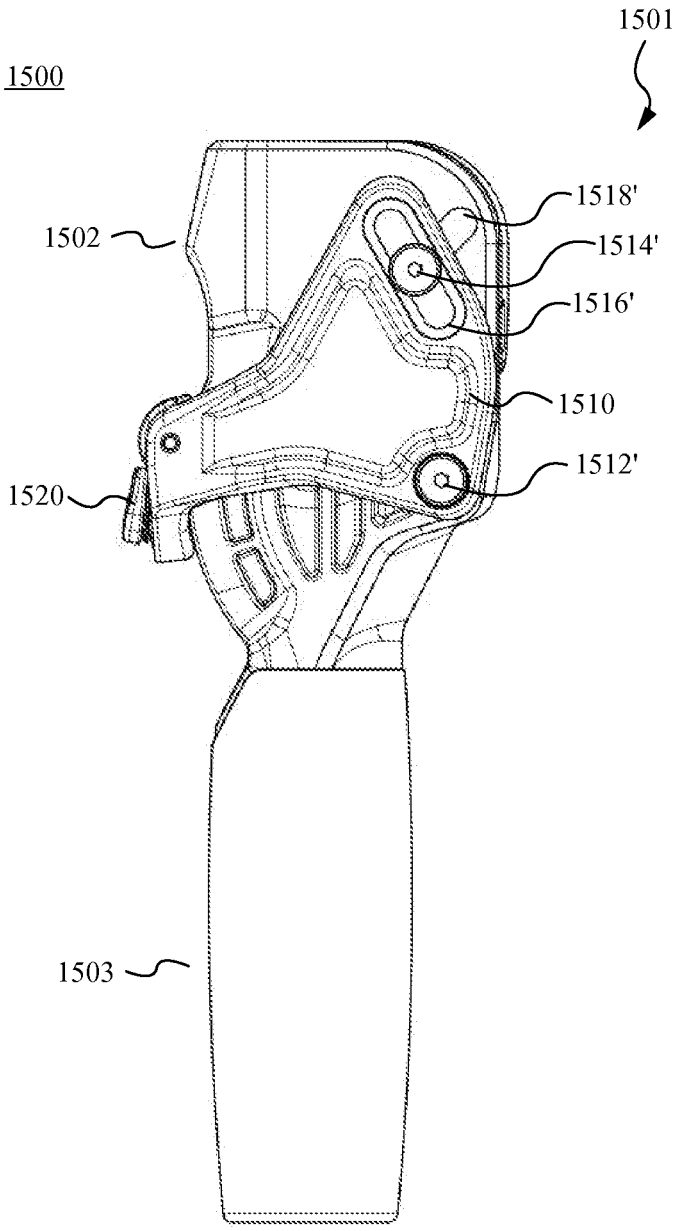
FIG. 15 illustrates a right side view of an adjustable tool handle for holding a tool during use in accordance with some embodiments.

FIG. 15 illustrates a right side view of an adjustable tool handle for holding tools during use. As shown in the left side view, the tool handle 1500 comprises a tool handle body 1501 having a first end 1502 and a second end 1503, and an adjustment mechanism 1510, and a track 1518. The adjustment mechanism 1510 comprises a pivot screw 1512' an adjustment screw 1514', a track 1516, and a button 1520. The pivot screw 1512' and the adjustment screw 1514' secure the pivot pin 1512 and the adjustment pin 1514 within the tool handle 1500, respectfully.

Figure 16:
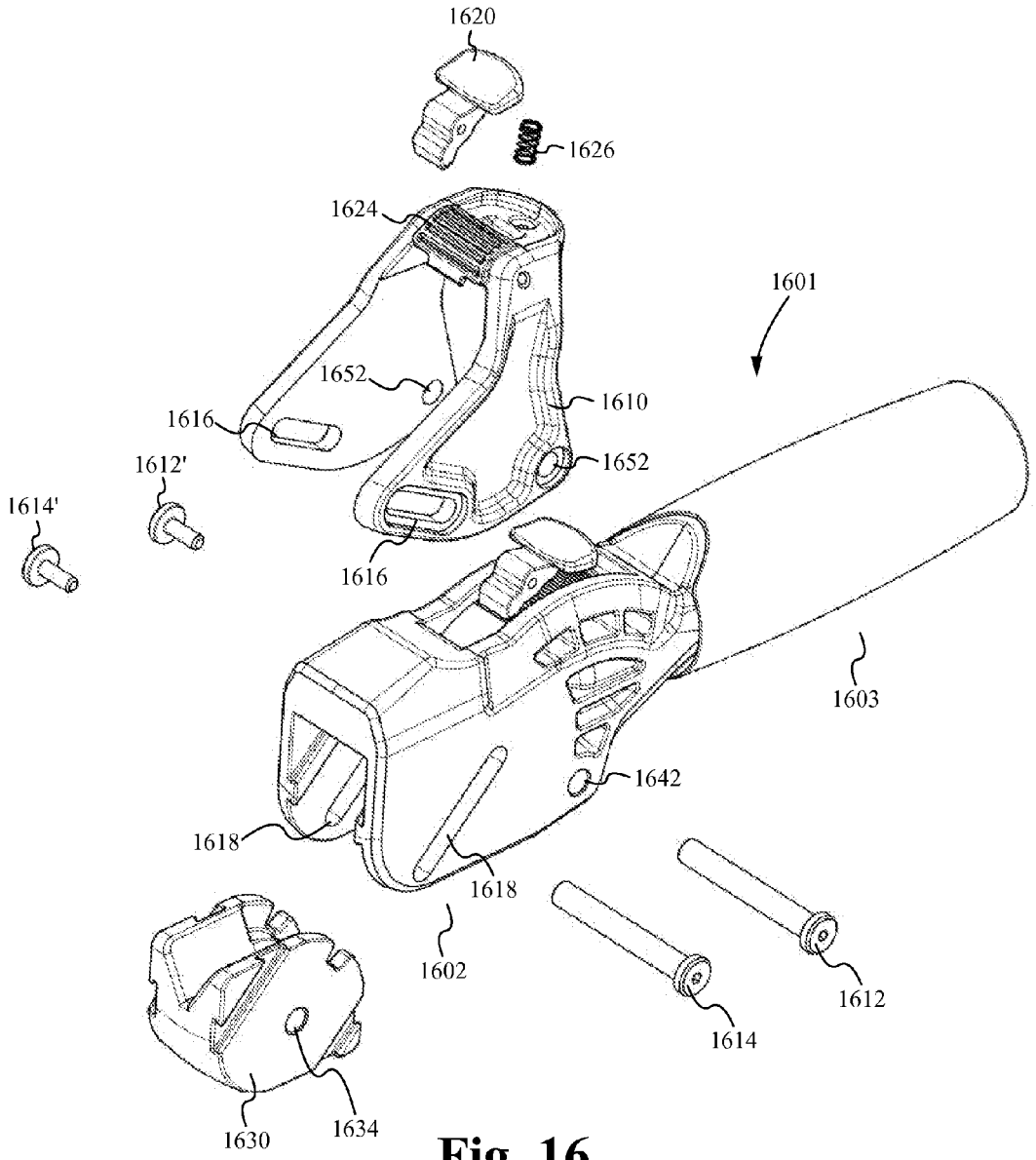
FIG. 16 illustrates an exploded view of an adjustable tool handle for holding a tool during use in accordance with some embodiments.

FIG. 16 illustrates an exploded view of an adjustable tool handle for holding a tool in accordance with some embodiments. The exploded view shows the tool handle body 1601 having a first end 1602, a second end 1603, a track 1618, and a pivot pin hole 1642. The adjustment mechanism 1610 comprises a button 1620, a track 1616, a pivot pin hole 1652, and a lock 1624. In some embodiments, the button 1620 is coupled to the adjustment mechanism by a spring 1626. The retaining component 1630 comprises an adjustment pin hole 1634. In some embodiments, the retaining component 1630 comprises an aperture on the front of the retaining component 1630. In some embodiments, the aperture is configured for receiving a portion of a tool.

In an assembled configuration, the retaining component 1630 is placed within the first end 1602 of the body 1601 and the adjustment mechanism 1610 is placed over the first end 1602 of the body 1601. Then, the retaining component 1630 and the adjustment mechanism 1610 are secured in place by placing the pivot pin 1612 through the pivot pin hole 1652 of the adjustment mechanism 1610 and the pivot pin hole 1642 of the body 1601 and placing the securing pin through the track 1618 and 1618' and the adjustment pin hole 1634 of the retaining component 1630. Once the pivot pin 1612 and the adjustment pin 1614 are put in place, the pivot pin 1612 and the adjustment pin 1614 are secured with the pivot screw 1612' and the adjustment screw 1614'. In the assembled configuration, the retaining component 1630 is able to travel the length of the track 1618. In some embodiments, as shown in FIG. 16, the track 1618 is diagonally shaped from a center of the first end 1602 to an outside top of the first end 1602 which enables the retaining component 1630 to move up and out from the body 1601 when the retaining component 1630 is pushed from the bottom of the track 1618 to the top of the track 1618.

Figure 17:
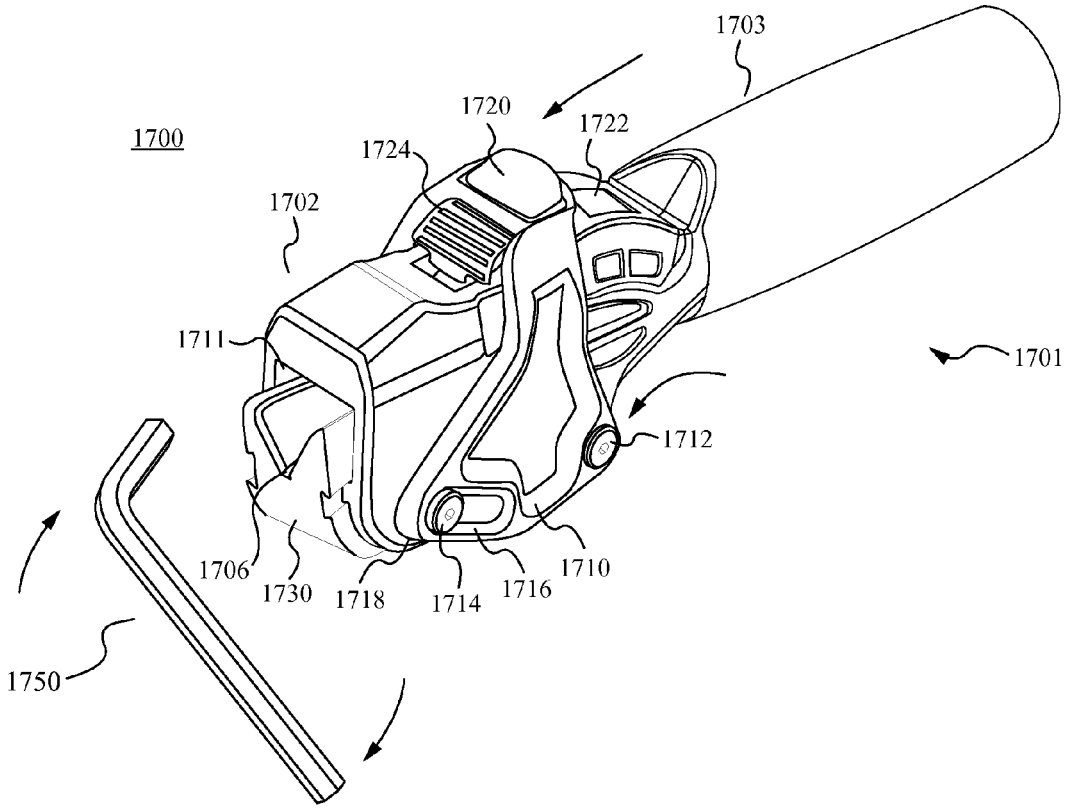
FIG. 17 illustrates an adjustable tool handle for holding a tool during use in an open configuration in accordance with some embodiments.

FIG. 17 illustrates the tool handle with the retaining component 1730 pushed in an upward and outward direction and to an open position. With the retaining component 1730 in an open position, the adjustable aperture 1711 moves to a second position and a user is able to removably couple a L-shaped hexagonal or round tool with the tool handle 1700. The retaining component 1730 is moved to the open position by pushing the button 1720 in an upward direction. As shown in FIG. 17, when the retaining component 1730 is pushed in an upward direction, the adjustment mechanism 1710 pivots in a forward and downward direction about the pivot pin 1712 and the adjustment pin 1714 moves along the track 1716 and the track 1718 and the retaining component 1730 is pushed upward and outward from the tool handle body 1701.

Figure 18A:
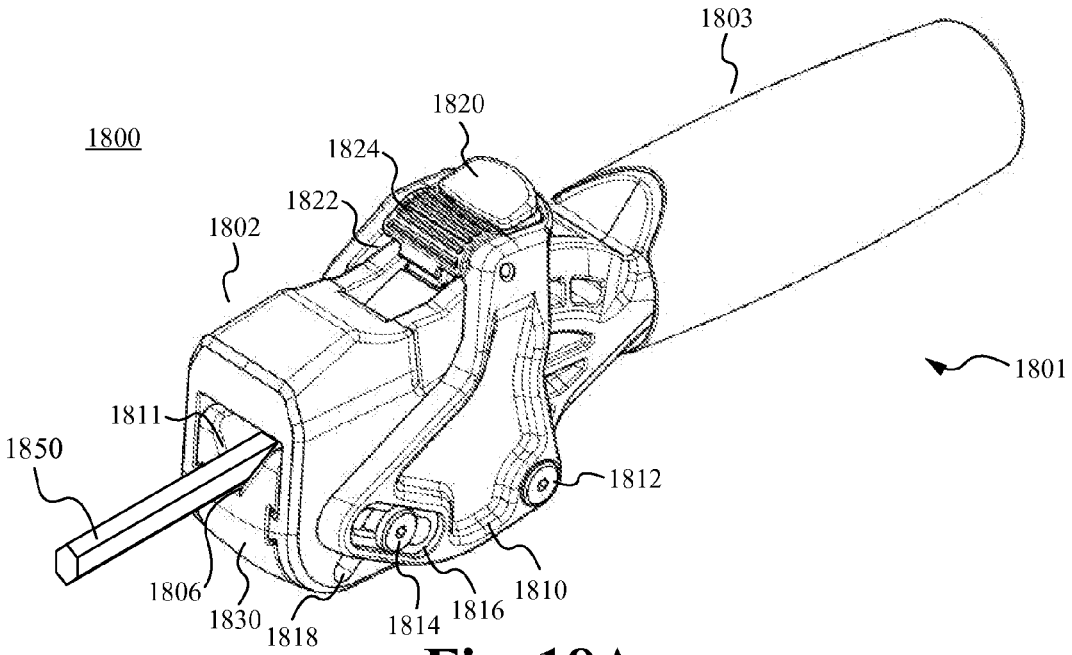
FIGS. 18A and 18B illustrate a tool coupled with an adjustable tool handle for holding a tool during use in accordance with some embodiments.

In some embodiments, in order to position a tool within the tool handle 1700 a short leg 1750 of a L-shaped hexagonal or round tool 1750 is inserted into the opening 1706. After the short leg is inserted into the opening 1706, the tool 1750 is turned so that the long leg extends from the first end 1702 of the tool handle 1700. As shown in FIG. 18A, when the button 1820 is released and the retaining component 1830 is retracted and securely holds the tool 1850 within the body 1801 with the long leg of the tool 1850 extending from the first end 1802 of the tool handle 1800 and in an operative position. In some embodiments, the body 1801 comprises one or more apertures on the back side of the body 1801. In some of these embodiments, when the tool 1850 is coupled with the tool handle 1800 so that the long leg extends from the first end 1802, the short leg of the tool 1850 extends through one of the one or more apertures and from the back side of the tool handle body 1801.

Figure 18B:
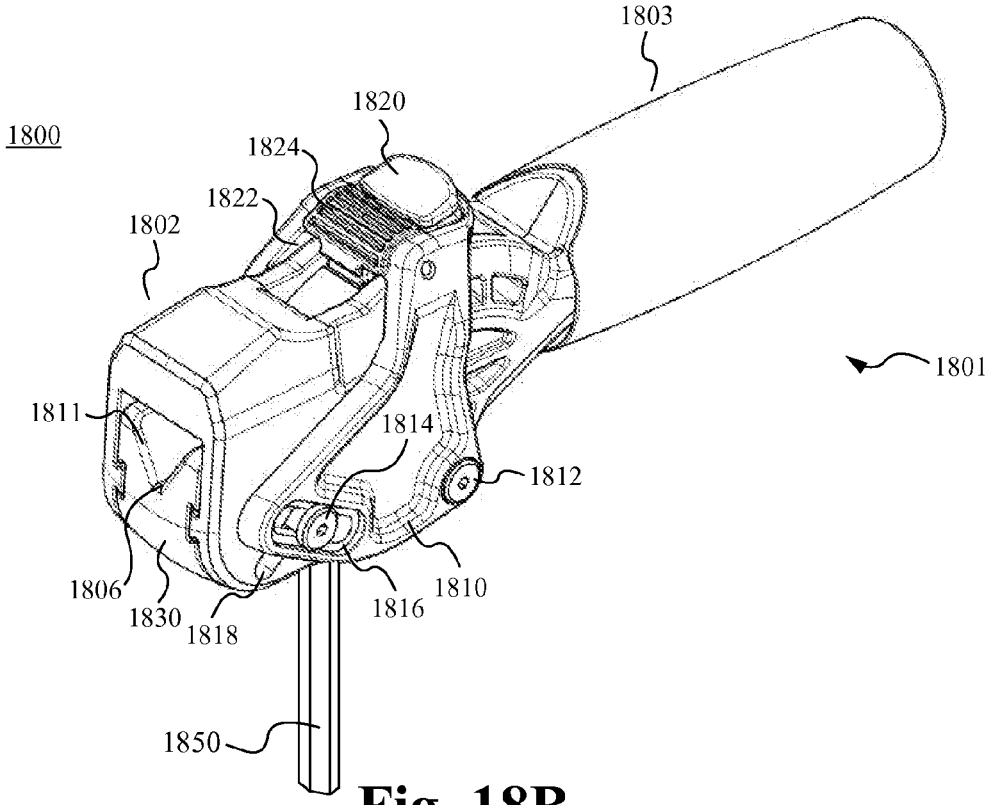

Alternatively, as shown in FIG. 18B, where the first end 1802 comprises an aperture on the back side of the body 1801, the tool is able to be positioned in the body 1801 so that the long leg of the tool 1850 extends from the back side of the body 1801. To position the tool 1850 so that the long leg of the tool 1850 extends from the back side of the tool handle 1800, the long leg of the tool 1850 is inserted into the opening 1806. After the long leg is inserted into the opening 1806, the tool 1850 is turned and the long leg is inserted into and through the aperture on the back side of the body 1801 so that the long leg extends from the back side of the body 1801. When the button 1820 is released, the retaining component 1830 is retracted and securely holds the tool 1850 within the body 1801 with the long leg of the tool 1850 extending from the back side of the tool handle 1800 and in an operative position.

When an L-shaped hexagonal or round tool is placed within the tool handle, the retaining component pushes the tool so that the tool is confined within the v-shaped bottom. In this manner, the tool handle is able to hold multiple tools of different sizes. Specifically, as the size of the tool decreases, it is pushed farther into the v-shaped bottom. The retaining component pushes on the long leg member and the short leg member of the tool and securely confines the tool within the tool handle. This arrangement also allows for the tool to be positioned as close to an end of the handle as possible in order to maximize leverage.

When the tool is securely held within the tool handle 1800, a user is able to easily install or remove an object such as a screw with the benefit of a comfortable handle. In some embodiments, the second end 1803 of the tool handle 1800 is ergonomically shaped so as to comfortably fit within a hand of a user. In some embodiments, the second end 1803 of the tool handle 1800 is rubber and/or textured in order to enable a user to easily grip the tool handle 1800.

In some embodiments, the adjustable tool handle for holding a tool during use is designed to be utilized with hexagonal wrenches of English sizes including a 9/32 inch hexagonal wrench, a 1/4 inch hexagonal wrench, a 7/32 inch hexagonal wrench, a 3/16 inch hexagonal wrench, a 5/32 inch hexagonal wrench, a 9/64 inch hexagonal wrench, a 1/8 inch hexagonal wrench, a 7/64 inch hexagonal wrench, a 3/32 inch hexagonal wrench and a 5/64 inch hexagonal wrench.

In some embodiments, the adjustable tool handle for holding a tool during use is also designed to be utilized with hexagonal wrenches of metric sizes including a 10 mm hexagonal wrench, an 8 mm hexagonal wrench, a 6 mm hexagonal wrench, a 5 mm hexagonal wrench, a 4.5 mm hexagonal wrench, a 4 mm hexagonal wrench, a 3.5 mm hexagonal wrench, a 3 mm hexagonal wrench, a 2.5 mm hexagonal wrench and a 2 mm hexagonal wrench.

Alternatively, the adjustable tool handle for holding a tool during use is able to be used with tools other than hexagonal wrenches. For example, a flat screwdriver is able to be used with the tool handle by including it on the end of a hexagonal L-shaped tool. Alternatively, a phillips screwdriver is also able to used with the tool handle by also including it on the end of a hexagonal L-shaped tool. In some embodiments, the tool handle is used with tools including a square head screwdriver, a star head screwdriver, and other tools.

In some embodiments, the tool is a hex wrench having an L-shaped body including a long leg member and a short leg member. In further embodiments, a ratcheting mechanism is removably coupled to the tool handle. The ratcheting mechanism is able to receive sockets and bits of different sizes in order to tighten or loosen nuts and bolts of different sizes. Alternatively, as described above, the ratcheting mechanism is able to be used with other tools such as a flat head screwdriver, a phillips head screwdriver and a hexagonal tool.

The adjustable tool handle for holding a tool during use is able to be composed of any appropriate material, which is of maximum strength and includes properties which resist materials that the handle will likely be exposed to, e.g., oil, grease, gasoline and the like. In some embodiments, the tool handle is materially composed of a variety of resin polymer and copolymer compositions including fillers and reinforcing materials such as glass in order to meet the strength and chemical resistance requirements of the tool. In some embodiments, the tool handle is materially composed of any suitable composition including, but not limited to aluminum or steel. In some embodiments, the tools are materially composed of aluminum, steel or any other appropriate material.

In some embodiments, the adjustable tool handle for holding a tool during use is constructed using an injection molded, core/cavity process as is well known in the art. Alternatively, the tool handle is able to be constructed in any known manner.

To utilize the adjustable tool handle for holding a tool during use, a tool is placed within the tool handle where it is held in place by a retaining component. In some embodiments, the tool is a L-shaped hexagonal or round tool. Once the tool is positioned and held within the adjustable tool handle, a user is able to easily install or remove an object such as a screw with the benefit of a comfortable handle.

The adjustable tool handle is able to be used with the tool extending out of the end of the tool handle or with the tool extending from the side of the tool handle. Consequently, a user is able to select the configuration which allows a user to achieve the greatest convenience and the most leverage for their desired task. Particularly, when a tool is inserted into the tool handle it is held into place on two faces of the tool, which are positioned at a right angle. The compound action of the retaining component on the tool allows the user to generate significant force in order to maximize the hold of the retaining component. This arrangement also allows for every size wrench to be positioned as close to the end of the handle as possible. Since each tool positioned in the tool handle is positioned close to an end of the tool handle, the user is able to maximize the lever arm length of the tool and the resulting force that can be applied.

The tool handle is also usable with a removable ratcheting mechanism. When the ratcheting mechanism is attached to the tool handle, the ratcheting mechanism is able to couple with a plurality of bits and sockets of different sizes, a hexagonal wrench, a flathead screwdriver and a phillips head screwdriver. The adjustable tool handle for holding a tool during use provides comfort and speed for installing and removing objects such as screws and bolts. In operation, the adjustable tool handle for holding a tool during use provides comfort and speed for installing and removing objects such as screws and bolts.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the appended claims.

What is claimed is:

1. A tool handle for holding a tool having a long leg member and a short leg member during use comprising:

a. a body having a first end, a second end, and an arm extending from a side of the body, the arm having an arm opening comprising a v-shape configured for receiving the tool;

b. the body having an adjustable opening comprising a v-shape for receiving one of a plurality of tools of different sizes; and c. a retaining component that holds the tool in the adjustable opening during use, wherein the retaining component is configured to push on the long leg member and the short leg member of the tool towards a bottom of the respective arm opening and the adjustable opening to hold the tool within the v-shape openings and further wherein the retaining component is held within the tool handle by a resilient member;

wherein an operable end of the tool is capable of optionally extending from either the first end or the arm of the tool handle during use.

2. The tool handle of claim 1 wherein the second end comprises an ergonomically shaped handle portion for holding during use.

3. The tool handle of claim 1 wherein the retaining component is manually moved from a closed position to an open position in order to place the tool within the adjustable opening and is manually retracted back to the closed position in order to hold the tool within the opening.

4. A tool handle for holding a tool during use comprising:

a. a body having a first end, a second end and an arm extending from a side of the body, the arm having an arm opening comprising a v-shape configured for receiving a ratcheting mechanism with a long mounting leg and a short mounting leg;

b. the body having an adjustable opening comprising a v-shape configured for receiving the ratcheting mechanism;

c. a retaining component that holds the ratcheting mechanism in the adjustable opening during use, wherein the retaining component holds the ratcheting mechanism by pressing the long and short mounting legs towards a bottom of the respective arm opening and the adjustable opening and further wherein the retaining component is held within the tool handle by a resilient member;

wherein an operable end of the ratcheting mechanism is capable of optionally extending from either the first end or the arm of the tool handle during use.

5. A method of utilizing an adjustable tool handle for holding a plurality of different sized tools, each tool having a long leg member and a short leg member, the method comprising:

a. moving a retaining component to an open position;

b. placing a tool within an adjustable opening of the tool handle, wherein the adjustable opening comprises a v-shape opening in the handle and a v-shape opening in an arm extending from a side of the handle; and c. moving the retaining component to a closed position, wherein the retaining component pushes on the long leg member and the short leg member towards a bottom of the respective openings in the handle and arm to hold the tool within the adjustable opening of the tool handle, wherein the retaining component is held within the tool handle by a resilient member to bias the retaining component to the closed position;

wherein an operable end of the tool is capable of extending from either a first end or the arm during use, and wherein, the arm is configured for receiving the tool.

6. The method of claim 5 wherein the retaining component is moved to the open position by moving a slidable button.

7. The method of claim 6 wherein moving the retaining component to a closed position comprises releasing the slidable button.

8. The method of claim 5 wherein the tool is a hex wrench having an L-shaped body including a long leg member and a short leg member.

9. The method of claim 5 wherein the tool is a ratcheting mechanism.

10. The method of claim 9 wherein the ratcheting mechanism removably receives one of a plurality of bits or sockets, each sized to fit a different sized work piece.

11. The method of claim 9 wherein the ratcheting mechanism removably receives one or more of a hexagonal bit, a flathead bit, a phillips head bit, a square head bit, a star head bit, and other shaped bits.

* * * * *